US011346624B2

(12) United States Patent
DeRoche et al.

(10) Patent No.: US 11,346,624 B2
(45) Date of Patent: May 31, 2022

(54) PROJECTILE LOADING SYSTEM FOR TOY LAUNCHER AND METHODS

(71) Applicant: Hasbro, Inc., Pawtucket, RI (US)

(72) Inventors: Robert J DeRoche, Glocester, RI (US); Robert C Maschin, Johnston, RI (US); Mark Anders, Tai Po (HK)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 17/064,338

(22) Filed: Oct. 6, 2020

(65) Prior Publication Data

US 2021/0102769 A1 Apr. 8, 2021

Related U.S. Application Data

(60) Provisional application No. 62/911,448, filed on Oct. 7, 2019.

(51) Int. Cl.
*F41A 9/02* (2006.01)
*F41B 7/08* (2006.01)

(52) U.S. Cl.
CPC . *F41A 9/02* (2013.01); *F41B 7/08* (2013.01)

(58) Field of Classification Search
CPC .... F41A 9/02; F41B 7/08; F41B 11/52; F41B 11/53
See application file for complete search history.

(56) References Cited

U.S. PATENT DOCUMENTS 1,403,719 A 1/1922 Szepe
3,348,531 A 10/1967 Yano
4,715,514 A 12/1987 Vidondo
4,796,893 A 1/1989 Choi
5,282,454 A 2/1994 Bell et al.
D354,997 S 1/1995 Arad et al.
5,611,321 A 3/1997 Hoeting et al.
5,984,788 A 11/1999 Lebensfeld et al.
6,261,180 B1 7/2001 Lebensfeld et al.
D449,354 S 10/2001 Hornsby et al.
6,302,796 B1 10/2001 Lebensfeld et al.
6,327,953 B1 * 12/2001 Andresen ..... F41A 9/02 124/45
D454,166 S 3/2002 Hornsby et al.
D458,975 S 6/2002 Hornsby et al.
6,415,781 B1 * 7/2002 Perrone ..... F41B 11/53 124/51.1

(Continued)

FOREIGN PATENT DOCUMENTS

DE 894369 A 10/1953

OTHER PUBLICATIONS

PCT/US20/54577 ISR Transmittal, Written Opinion, and ISA Search 1-750 PCT papers dated Jan. 22, 2021.

*Primary Examiner* — Bret Hayes
(74) *Attorney, Agent, or Firm* — Perry Hoffman

(57) ABSTRACT

Projectile loading systems for toy launchers that discharge soft spherical, but tacky, projectiles, the loading systems including a projectile hopper for storing the projectiles, a chute at the bottom of the hopper, the chute having a central groove for lining the projectiles in a single file, an agitator in the hopper for disturbing the tacky projectiles in the hopper to separate them, and a projectile transfer structure for carrying a projectile, one at a time, from the chute to a breech or from a feed track during respective priming cycles.

20 Claims, 28 Drawing Sheets

(56) References Cited

U.S. PATENT DOCUMENTS

| | | | | |
|---|---|---|---|---|
| 6,418,919 | B1 * | 7/2002 | Perrone | F41B 11/53 124/49 |
| 6,523,535 | B2 | 2/2003 | Rehlemper et al. | |
| 6,698,128 | B2 | 3/2004 | Kessler | |
| D504,489 | S | 4/2005 | Cerovic | |
| D508,277 | S | 8/2005 | Cerovic | |
| 7,163,009 | B2 | 1/2007 | Brown et al. | |
| D557,355 | S | 12/2007 | Higuchi et al. | |
| D588,214 | S | 3/2009 | Stadlbauer | |
| 7,603,998 | B2 | 10/2009 | Finstad | |
| D635,620 | S | 4/2011 | Nadel | |
| 8,082,909 | B2 | 12/2011 | Sopkinsly et al. | |
| D664,609 | S | 7/2012 | Johnson | |
| 8,596,254 | B2 | 12/2013 | Brooks et al. | |
| 8,820,305 | B2 | 9/2014 | Victor et al. | |
| 8,875,688 | B2 | 11/2014 | Nugent | |
| 8,955,503 | B2 | 2/2015 | Corsiglia et al. | |
| 9,958,230 | B1 | 5/2018 | Nugent et al. | |
| 10,488,143 | B2 | 11/2019 | Victor et al. | |
| 10,648,763 | B2 | 5/2020 | Chia et al. | |
| 10,648,767 | B2 | 5/2020 | Chia et al. | |
| 10,871,343 | B2 | 12/2020 | Chia et al. | |
| 2006/0086347 | A1 | 4/2006 | Hedberg | |
| 2007/0023024 | A1 * | 2/2007 | Yeh | F41B 11/53 124/49 |
| 2008/0257327 | A1 * | 10/2008 | Monks | F41B 11/50 124/48 |
| 2011/0290226 | A1 * | 12/2011 | Kaakkola | F41B 11/52 124/49 |
| 2019/0195592 | A1 | 6/2019 | Chia et al. | |
| 2019/0195593 | A1 | 6/2019 | Chia et al. | |

* cited by examiner

PROJECTILE LOADING SYSTEM FOR TOY LAUNCHER AND METHODS

PRIORITY CROSS-REFERENCE TO RELATED APPLICATION

This application claims priority pursuant to 35 U.S.C. 119(e) from U.S. Provisional Patent Application No. 62/911,448 filed on Oct. 7, 2019.

FIELD OF THE INVENTION

The present invention relates generally to a toy launcher and, more particularly, to projectile loading systems for toy launchers.

BACKGROUND OF THE INVENTION

Battery operated flywheel are well known. For example, the following U.S. Patents illustrate such devices: U.S. Pat. No. 5,611,321 issued in 1997, U.S. Pat. No. 6,523,535 issued in 2003, U.S. Pat. No. 8,082,909 issued in 2011, U.S. Pat. No. 8,955,503 issued in 2015 and U.S. Pat. No. 9,958,230 issued in 2018. A hand operated toy ball launcher is disclosed in U.S. Pat. No. 7,163,009 issued in 2007 and more broadly a hopper holding ball objects are disclosed in U.S. Pat. No. 1,403,719 issued in 1922, U.S. Pat. No. 4,796,893 issued in 1989 and U.S. Pat. No. 5,282,454 issued in 1994. More broadly still, are patents for dispensing containers for items such as cutlery. An example is U.S. Pat. No. 4,715,514 issued in 1987. While some general features of the subject invention are known, the loading systems disclosed below in great detail for handling a unique projectile is unknown.

BRIEF DESCRIPTION OF THE DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DETAILED DESCRIPTION OF THE EMBODIMENTS

Figure 1:
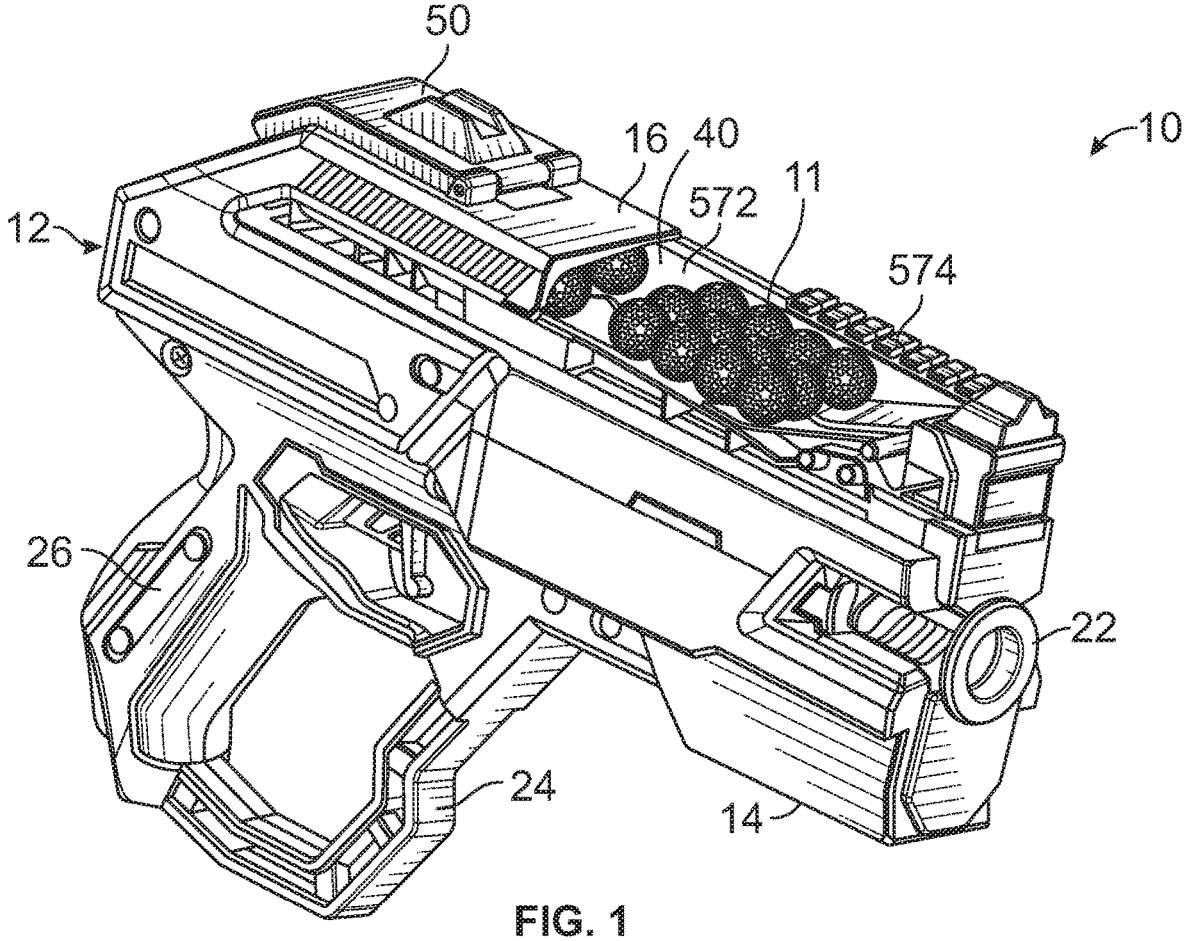
FIG. 1 is an isometric view of an embodiment of a toy launcher with soft spherical projectiles.

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

One embodiment of the present invention is a toy projectile launcher 10, FIGS. 1-4, for launching soft spherical toy projectiles, such as the projectile 11, FIGS. 1, 2, 4 and 5, which may made from one or more of elastomers, plastics, other polymeric resins, blends thereof, and combinations thereof. Elastomers may include, for example, thermoplastic elastomers (TPR or TPE) including, but not limited to, thermoplastic styrenic elastomers (TPS), such as styrene-ethylene-butylene-styrene polymers (SEBS), thermoplastic polyolefin (TPO), such as polypropylene, polyethylene, and copolymers thereof, thermoplastic polyurethanes (TPU), thermoplastic copolyester (TPC), thermoplastic polyamides (TPA), such as polyester-amid block copolymers, polyether-esteramide block copolymers, and polyether-amide block copolymers. Elastomers can include polysiloxanes, as known as silicones. The soft projectiles may include blends, mixtures, laminates, or other combinations of any of the foregoing materials. The soft projectiles can be formed of any material, blends, mixtures, or combinations such that the soft projectile has a Shore A hardness value of about 3 to about 30, about 5 to about 15, about 10 to about 20, or about 8 to about 25. Other suitable values include about 3, 4, 5, 6, 7, 8, 9, 10, 11, 12, 13, 14, 15, 16, 17, 18, 19, 20, 21, 22, 23, 24, 25, 26, 27, 28, 29, or 30. As a suitable projectile hardness range of compression, such may be targeted as between 0.8-1.0 Kg as suitable for launching using spinning launch wheels, such as the launch wheels 255, 256, FIG. 24, with projectiles advancing to shoot out between the launch wheels, and, alternatively, using pneumatic sealing with energy source 156, FIG. 15, or a spring-loaded piston 18, FIG. 4, of the launchers embodiments discussed herein in detail below.

Figure 2:
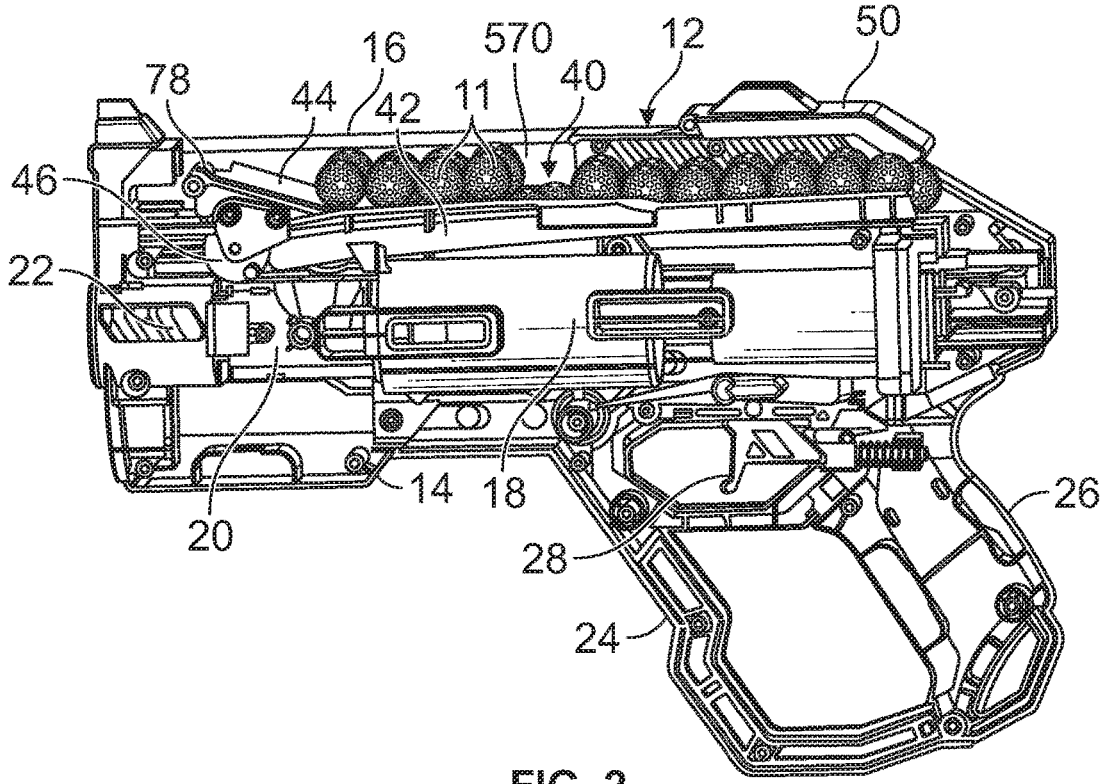
FIG. 2 is an isometric side view of the launcher illustrated in FIG. 1, with part of an outer housing removed to show the interior of the launcher and a projectile loading system.
Figure 4:
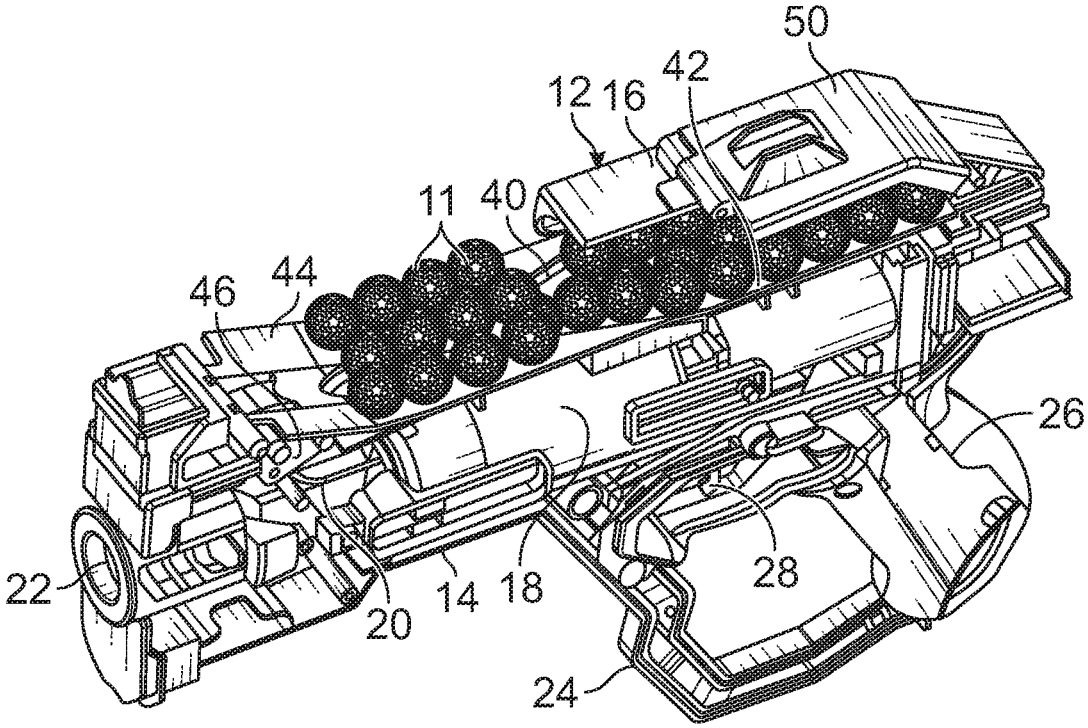
FIG. 4 is a downward looking isometric view of the toy launcher illustrated in FIGS. 1-4, showing the interior of the launcher and stored soft spherical projectiles.
Figure 5:
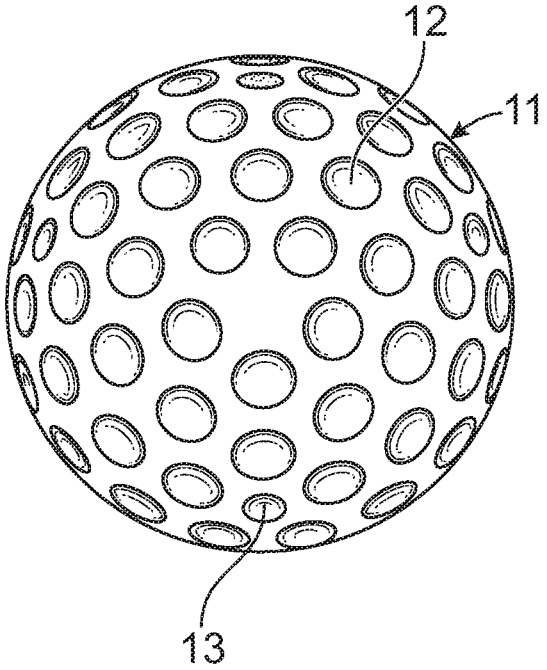
FIG. 5 is a view of a soft spherical projectile.

A preferred TPE is identified as GLS AB5-535, which is a 1 to 1 blend of CL2000X and G6713C. These TPEs compounds are available from Avient Corporation having an office in Avon Lake, Ohio. TPE GLS AB5-535 has a durometer hardness (Shore A) of 10, a density/specific gravity of 0.87, a weight of 1.44 g and a round hardness of 5.0-7.6 lbf. The soft projectiles are made in the form of small spheres 11, as illustrated in FIGS. 2, 4 and 5, with many large dimples, such as the dimple 12, FIG. 5, and a few small ones, such as the dimple 13. A preferred diameter of the soft projectile may be about 14.8 mm, and the Shore A hardness falls within a range between 7 and 11.

The launcher 10 includes an outer housing 12 having a lower or base portion 14 and an upper or priming portion 16. The lower portion 14 of the outer housing supports an energy source 18, a breech 20, a barrel 22, a trigger guard 24 and a grip 26. The energy source 18 may include a spring-loaded piston as is well know in the trade. A trigger mechanism 28, also well known in the trade, may be mounted in the lower portion 14 for activating the energy source 18.

The upper portion 16, FIG. 1, of the launcher 10 is slideably mounted to the lower portion 14 of the launcher. To prime or cock the launcher 10, the upper portion 16 is pulled rearward by one hand of an operator to the position shown in FIG. 3, relative to the lower portion 14, which remains stationary in the other hand of the operator. Mounted in the upper portion 16 are most of a loading system that includes a projectile hopper 40, FIGS. 2 and 4, a chute 42, an agitator 44 and a rotatable projectile transfer structure 46. A guide rail 48, FIGS. 3 and 13, of the loading system is mounted in the lower position 14. A similar guide rail (not shown) is mounted on the opposite side of the launcher.

Figure 2A:
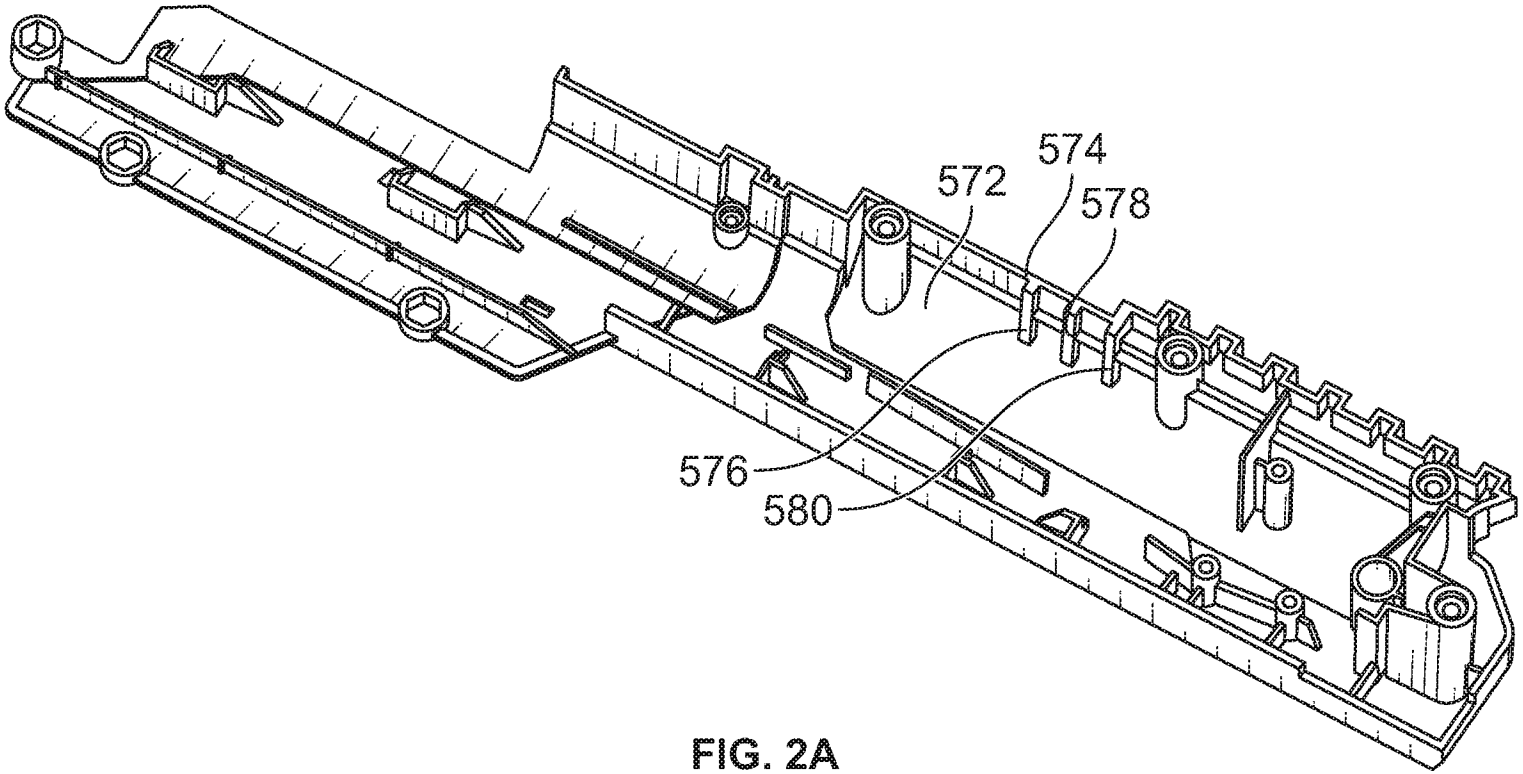
FIG. 2A is an isometric view of a partial sidewall and a partial top wall of the outer housing.
Figure 3:
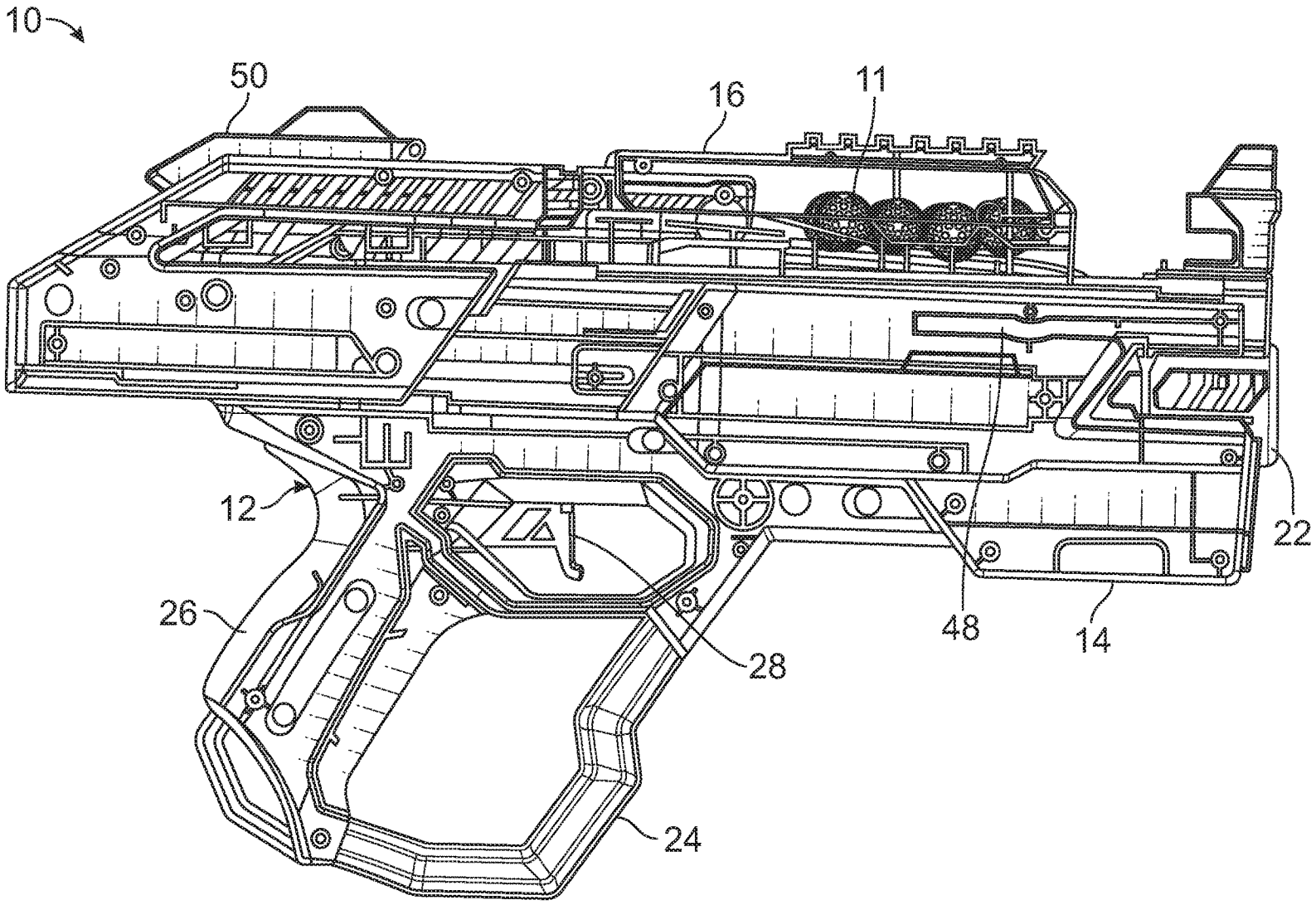
FIG. 3 is a side elevation view of the launcher illustrated in FIG. 1, during a priming cycle.

The hopper 40 is mounted to the upper portion 16 and travels with the upper portion 16 when the user manually primes the launcher 10. The hopper 40 includes two sidewalls 570, 572, FIGS. 1 and 2, and a top wall 574. The inner portion of the top wall 574, FIG. 2A, may include ribs, such as the ribs 576, 578, 580, to help prevent spherical projectiles from stacking up on one another in the hopper. A preferred dimension for the ribs may be 2.5 mm. The hopper is able to hold a large number, perhaps about forty or more, of the soft projectiles 11. The hopper 40 may be loaded through an opening beneath a closure panel 50, FIGS. 1-4.

Figure 6:
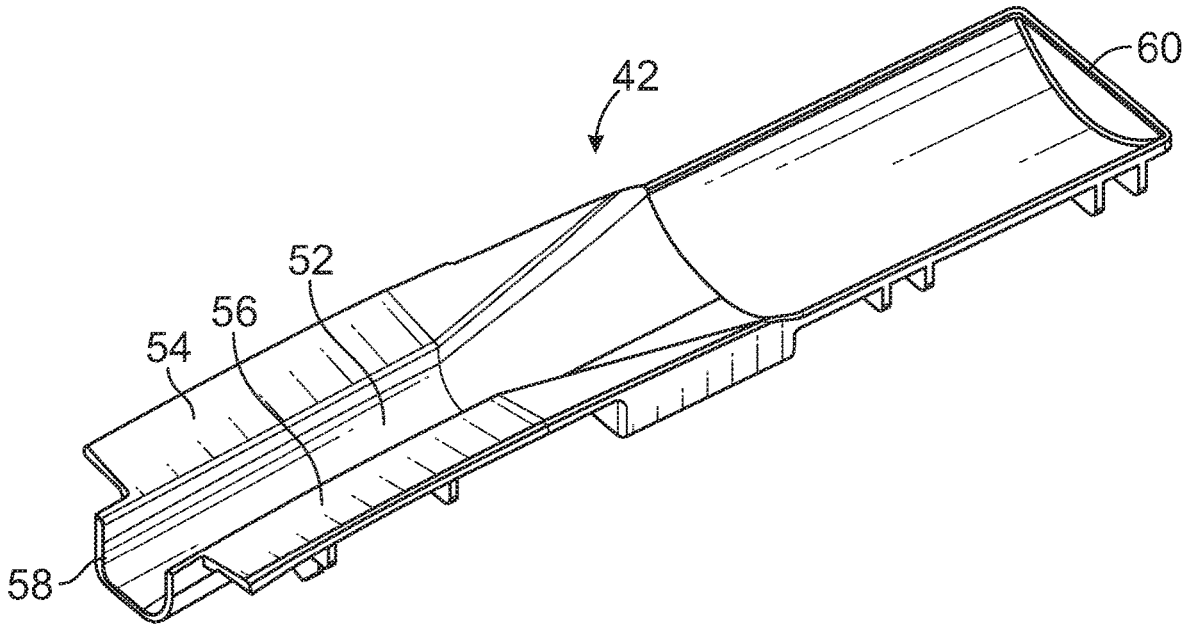
FIG. 6 is an enlarged downward-looking isometric view of a chute from the loading system in the toy launcher illustrated in FIGS. 1-4.
Figure 7:
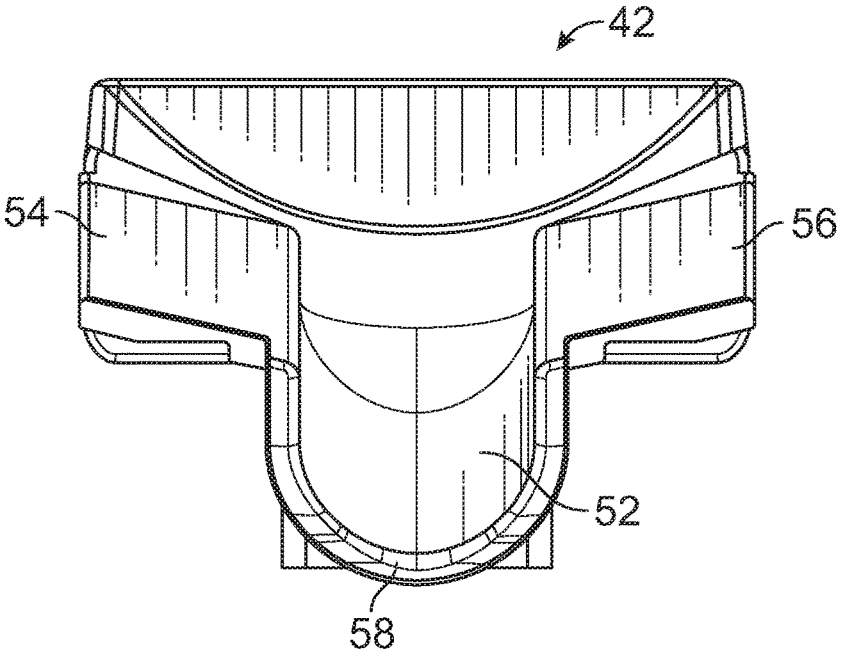
FIG. 7 is an enlarged front isometric view of the chute illustrated in FIG. 6.

Referring to FIGS. 6 and 7, the chute or directing structure 42 includes a central groove 52 bordered by two wing-like surfaces 54, 56, a forward end 58 and a rearward end 60. The surfaces 54, 56 are slanted toward the groove 52 and the chute is mounted to slope toward the forward end 58 such that the spherical projectiles 11 tend to roll toward the groove 52 and toward the forward end 58 of the chute as shown in FIGS. 2 and 7. The groove is narrow enough to allow a small percent of the projectiles to line up in a single file at a level below other projectiles that are above the single file and on the surfaces 54, 56 and further rearward on the chute 42.

Figure 7A:
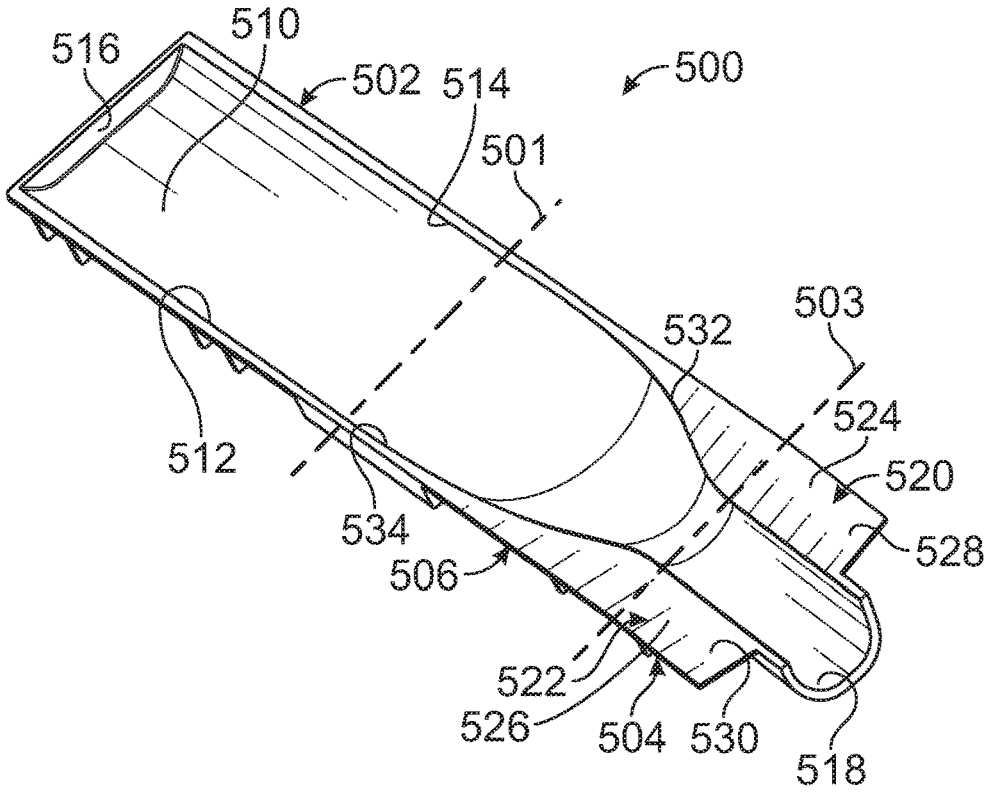
FIG. 7A is a downward-looking isometric view of an improved chute of the loading system in the toy launcher illustrated in FIGS. 1-4.
Figure 7B:
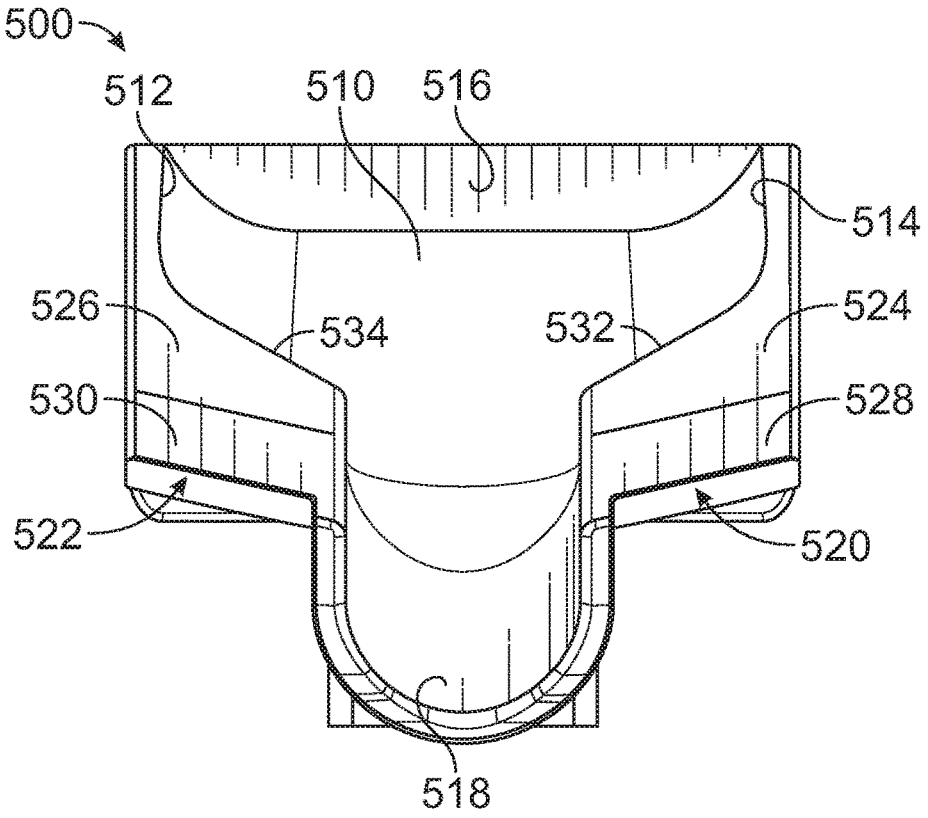
FIG. 7B is an enlarged front isometric view of the chute illustrated in FIG. 7A.

Referring now to FIGS. 7A and 7B, an improved version of an elongated chute or directing structure 500, located in the hopper 40, functions to direct the soft spherical projectiles 11 from the hopper 40 to the rotatable projectile transfer structure 46. The chute 500 may, for descriptive purposes, be divided generally in three portions, a rearward portion 502, a forward portion 504, and a transition portion 506, the transition portion being located between the forward and rearward portions. The portions 502, 504, 506 are approximately divided in FIG. 7A by phantom lines 501, 503, and the nomenclature provided, "forward," "rearward," and "transition," relates to the way the spherical projectiles 11 will move when the launcher is used by the operator.

The chute 500 includes a tray portion 510 in the rearward portion 502 with sidewalls 512, 514 and a rear wall 516. The chute 500 includes a groove or feed channel portion 518 in the forward portion 504 sufficiently wide to align the spherical projectiles 11 in a single file. To the sides of the groove 518 are two slanted wings 520, 522 inclined laterally to facilitate rolling of the spherical projectiles into the groove 518. The wings 520, 522 are also inclined in a forward longitudinally downward direction at a first angle in the rearward portions 524, 526 of the wings 520, 522, and at a second steeper angle in the forward portions 528, 530 of the wings 520, 522. The wings 520, 522 elevate the projectiles along the sides of the groove 518 to prevent the upper projectiles from obstructing the line of projectiles in the groove. The improved geometry of the chute 500 also allows more projectiles to be held in the hopper.

In the transition portion 506 of the chute 500, the sidewalls 512, 514 form smooth bottleneck-like curves 532, 534 so that the soft spherical projectiles flow easily in view of the fact that the spherical projectiles have a tendency to bind against one another because they are somewhat tacky and easily squeezed together. It is important that the structure of the wings 520, 522, and especially the curves 532, 534, encourage a smooth flow of the soft projectiles so as to avoid jamming the launcher.

Figure 8:
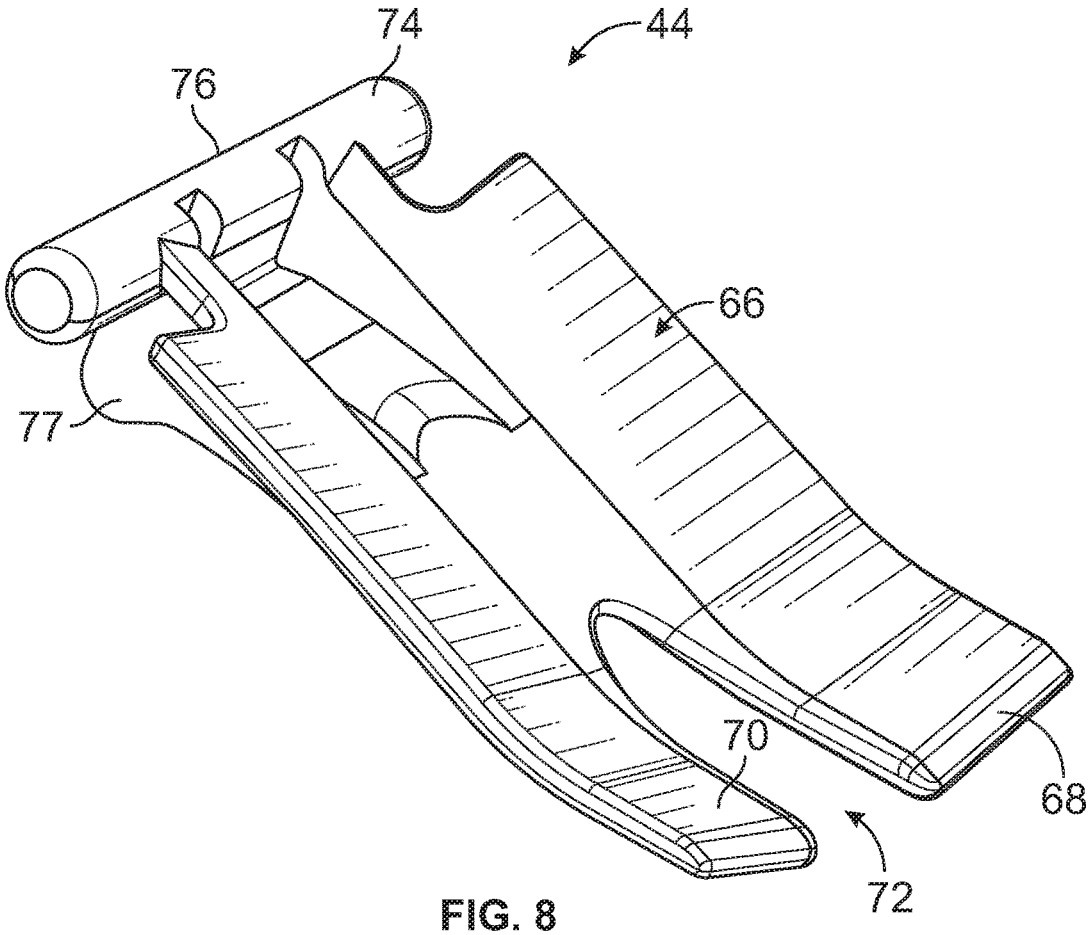
FIG. 8 is an enlarged downward looking isometric view of an agitator of the loading system.
Figure 9:
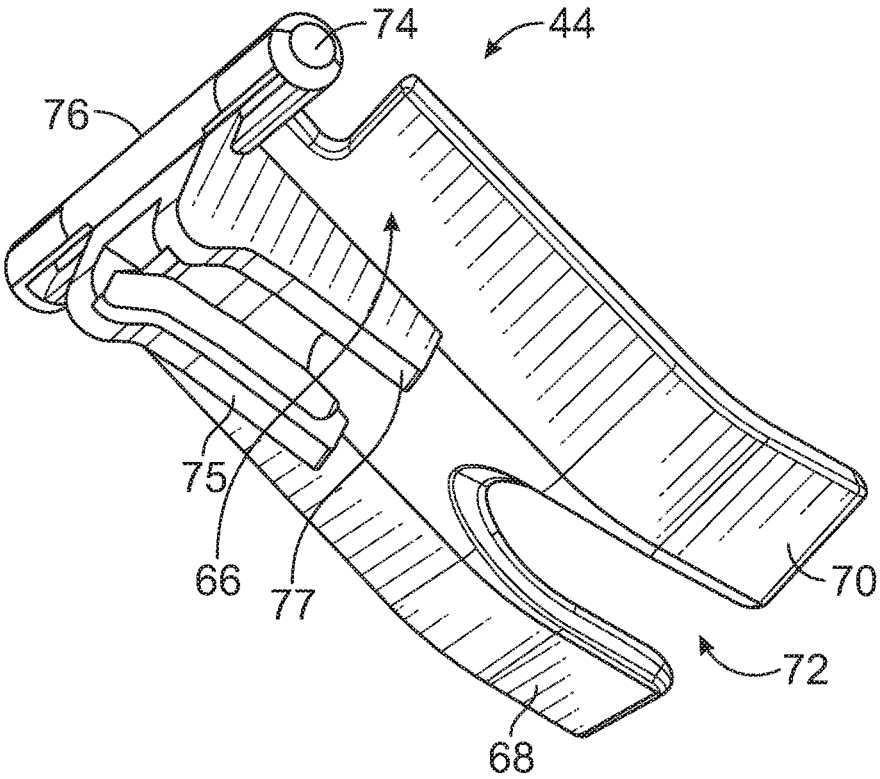
FIG. 9 is an upward looking isometric view of the agitator illustrated in FIG. 8.

Referring to FIGS. 2, 8 and 9, the rotatable agitator 44 is mounted to the upper portion 16 of the outer housing 12 in a manner so as to disturb, agitate and lift the projectiles and cause their separation from one another. This is especially needed because the material of the projectiles is somewhat tacky. The agitator 44 is formed as a lever 66 with two rearward extending blades 68, 70 and a space 72 between the blades so that the agitator 44 looks somewhat similar to an ordinary hammer claw. The agitator 44 also includes a lateral mounting shaft 74 at a forward end 76 of the lever 66 and a pair of cam follower flanges 75, 77 on the underside of the agitator. When the agitator rotates, the blades 68, 70 disturb close-in projectiles while allowing single projectiles to pass through the space 72 and fall into the groove 52 of the chute 42.

Figure 9A:
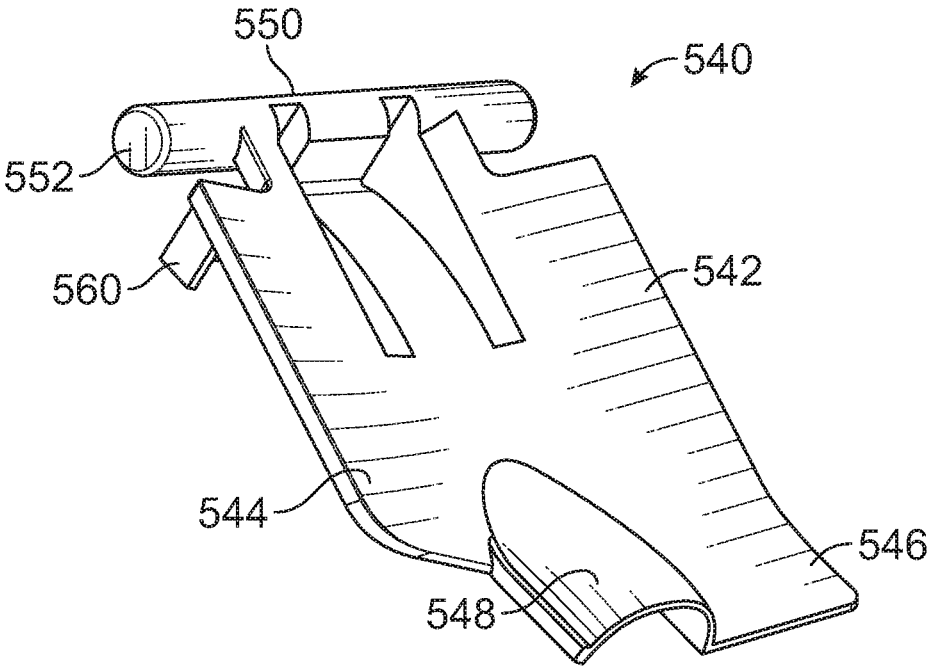
FIG. 9A is an enlarged downward looking isometric view of an improved agitator of the loading system.
Figure 9B:
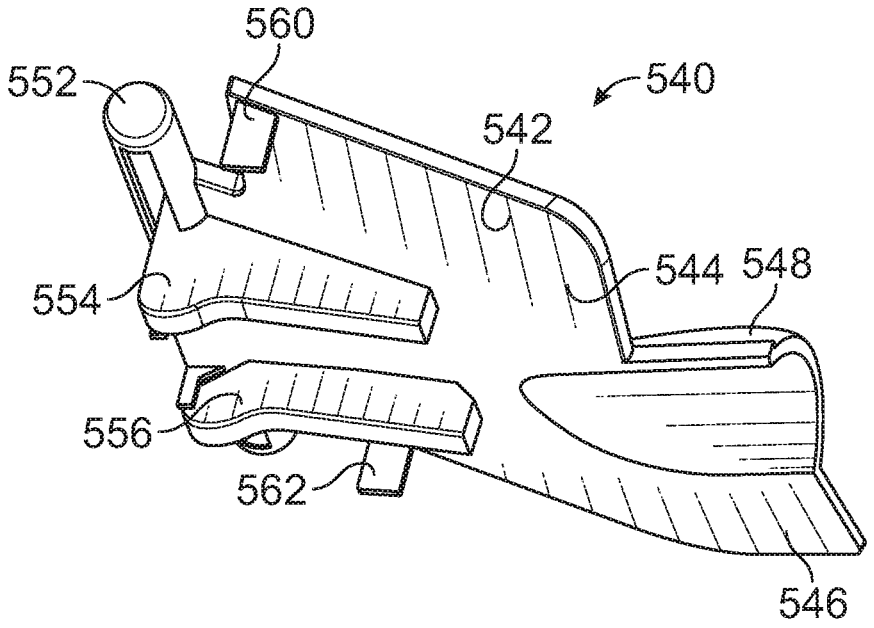
FIG. 9B is an upward looking isometric view of the improved agitator illustrated in FIG. 9A.

Referring now to FIGS. 9A and 9B, an improved version of a rotatable agitator 540 is illustrated. The agitator 540, located in the hopper 40, includes a curved scoop-like lever 542 with unequal or asymmetrical side arms 544, 546 where the arm 544 is shorter than the arm 546. Between the two arms 544, 546 is a rounded protuberance or hump 548. At a forward or upper end 550 of the agitator is a shaft 552, which allows the agitator to rotate. A pair of cam followers 554, 556 is formed on the underside of the agitator. Also located on the underside of the agitator 540 is a pair of tabs 560, 562.

The addition of the rounded protuberance 548 to the agitator 540 (as compared to the agitator 44, FIG. 8, not having a hump) prevents spherical projectiles in the hopper above the agitator 540 from obstructing those spherical projectiles located in the groove 518, FIGS. 7A and 7B, of the chute 500. The rounded protuberance 548 also helps separate the spherical projectiles. The asymmetrical side arms 544, 546 help to agitate the spherical projectiles in the hopper, moving them from left to right, for more effective flow of the projectiles in operation of the launcher 10. A preferred arrangement may have the left arm 544 set back from the right arm 546 by some 12 mm. The improved agitator 540 may also be used with the launcher 150, FIG. 14, and the launcher 250, FIG. 24, where the relative positions and dimensions of the arms may be altered to enhance operation. The chute 500 may also be used in the launch 150, with or without dimensional changes.

Located on the inside surface of the upper portion 16 of the outer housing 12 are bearing tubes, such as the bearing tube 78, FIG. 2, which each receives an end of the shaft 74, FIGS. 8 and 9. The bearing tube 78 allows the agitator to rotate and to lift or shovel the projectiles when the upper portion 16 of the outer housing 12 is primed, that is, when the operator of the launcher 10 moves the upper portion 16 rearward and then forward. When the projectiles fall into the groove of the chute, they align in a single file at a level below the surfaces 54, 56, FIG. 7.

Figure 10:
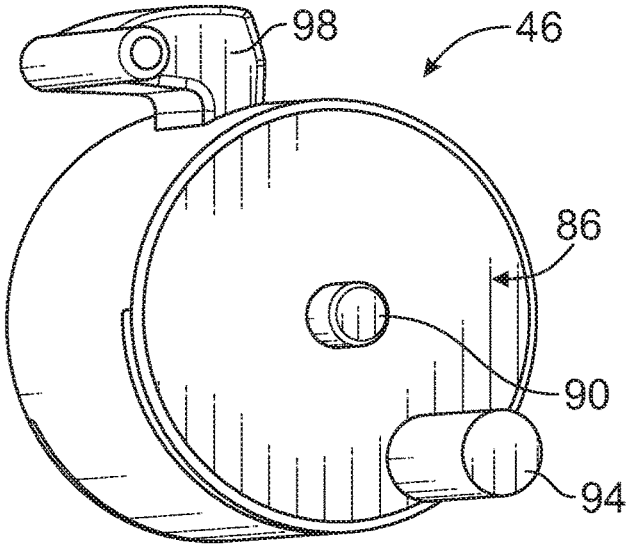
FIG. 10 is an enlarged isometric front view of a projectile transfer structure of the loading system.
Figure 11:
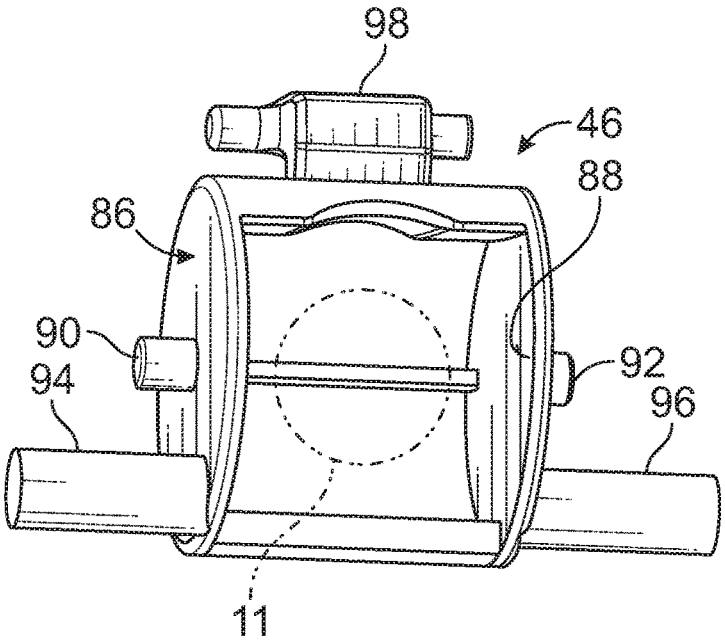
FIG. 11 is an isometric rear view of the projectile transfer structure illustrated in FIG. 10.
Figure 12:
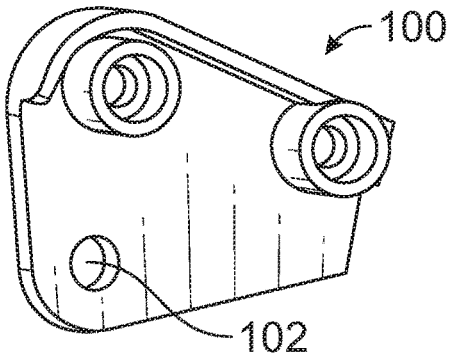
FIG. 12 is an isometric view of a bracket for supporting the projectile transfer structure illustrated in FIGS. 10 and 11.

The transfer structure 46, FIGS. 2, 10 and 11, may have a cylindrical housing 86 with an opening 88 to receive a single projectile 11, shown in phantom lines, opposite mounting shafts 90, 92, opposite guide shafts 94, 96 and a cam element 98. The mounting shafts 90, 92 are received in openings in a pair of brackets 100, 101, FIGS. 12 and 13, such as the opening 102 in the bracket 100, to allow the transfer structure 46 to rotate. The guide shafts 94, 96 move along guide rails, such as the guide rail 48, FIG. 13, on the inside surface of the lower portion 14 of the outer housing 12 when the operator of the launcher primes the launcher by moving the upper portion 16 of the outer housing 12.

Figure 13:
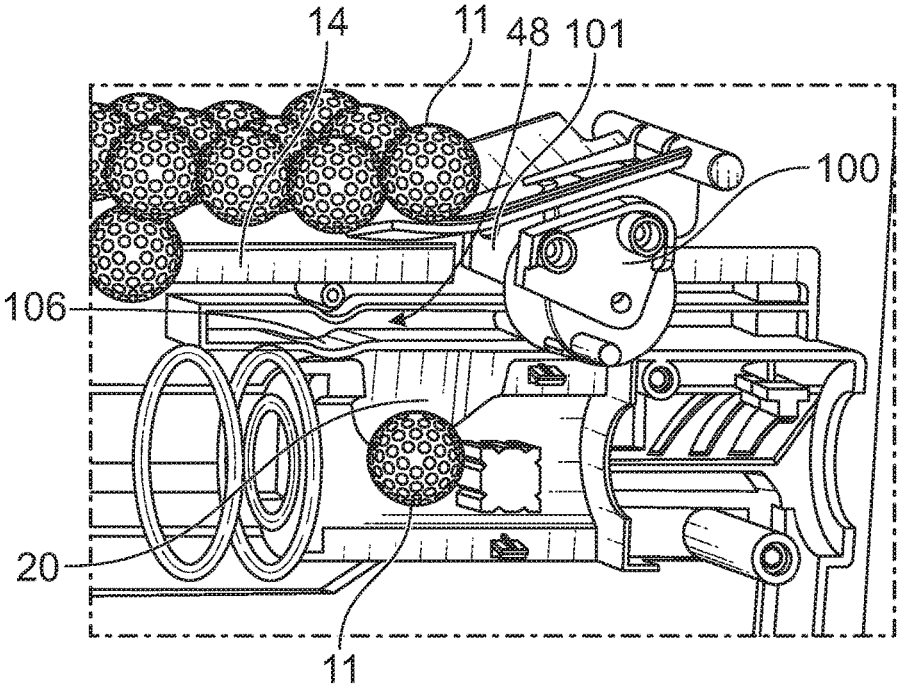
FIG. 13 is an enlarged isometric view of a guide rail for the projectile transfer structure.

The guide rails, such as the guide rail 48, FIG. 13, are generally linear except for dip sections, such as the dip section 106. When the guide shafts 94, 96 of the transfer structure 46 move rearward during the first pail of the priming cycle the guide shafts approach the dip sections 106. At the dip sections the transfer structure rotates in a clockwise direction causing a projectile 11 in the cylindrical housing 86 of the transfer structure 46 to dropout of the opening 88 into the breech 20. At the same time the cam element 98 rotates upward against the agitator flanges 75, 77, FIG. 9, causing the agitator to rotate and agitate some of the projectiles adjacent the agitator 44 and align one or more projectiles in the groove 52, FIGS. 6 and 7, of the chute 42. The improved agitator 540 operates in the same manner.

In operation of the loading system of the launcher 10, starting with a projectile 11 in the transfer structure 46, an empty breech 20 and before the priming cycle, the user or operator of the launcher 10 begins the priming cycle by holding the launch in one hand and sliding the priming portion 16 of the outer housing rearward with the other hand. At the dip sections 106 in the guide rails 48, the transfer structure 46 rotates to cause the agitator 44 to rise. Beyond the dip section, the agitator lowers and, toward the rearward end of the priming cycle, the projectile leaves the transfer structure and falls into the breech. As the priming cycle continues when the operator returns the priming portion 16 forward, the transfer structure rotates once more at the guide rail dip sections and the agitator rises again. Continuing the forward motion of the priming portion, the transfer structure is loaded with a new projectile from the groove of the chute and the agitator is lowered.

During the priming cycle, the energy source is cocked so that when the operator pulls the trigger mechanism a projectile will be launched.

Figure 14:
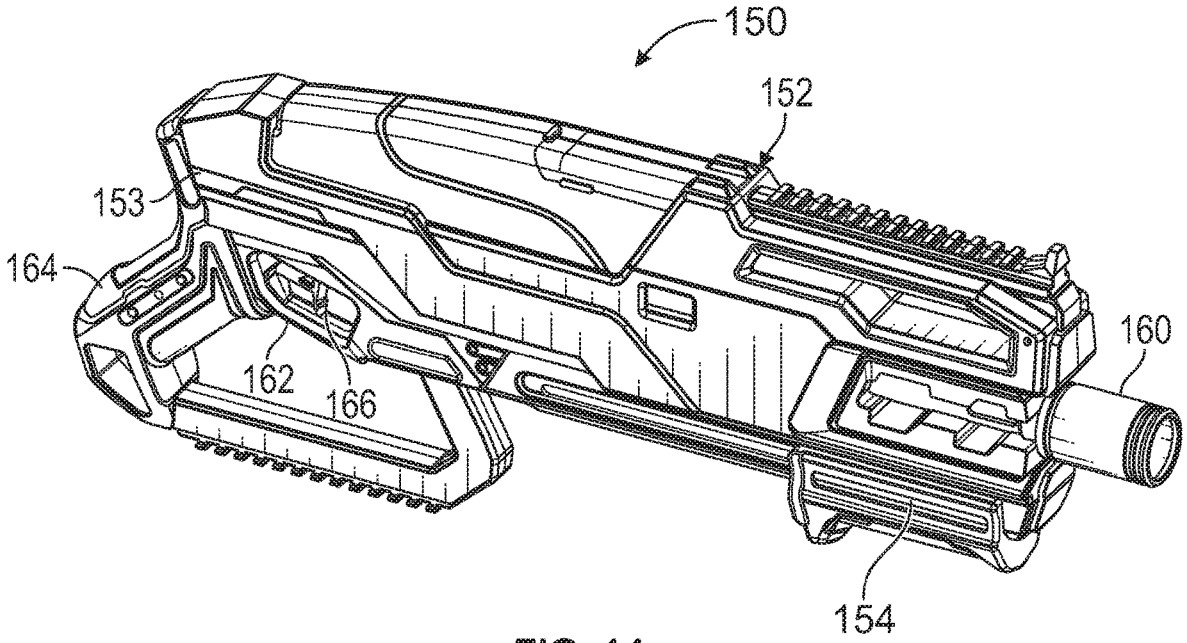
FIG. 14 is an isometric view of another embodiment of a toy launcher with a projectile loading system.
Figure 15:
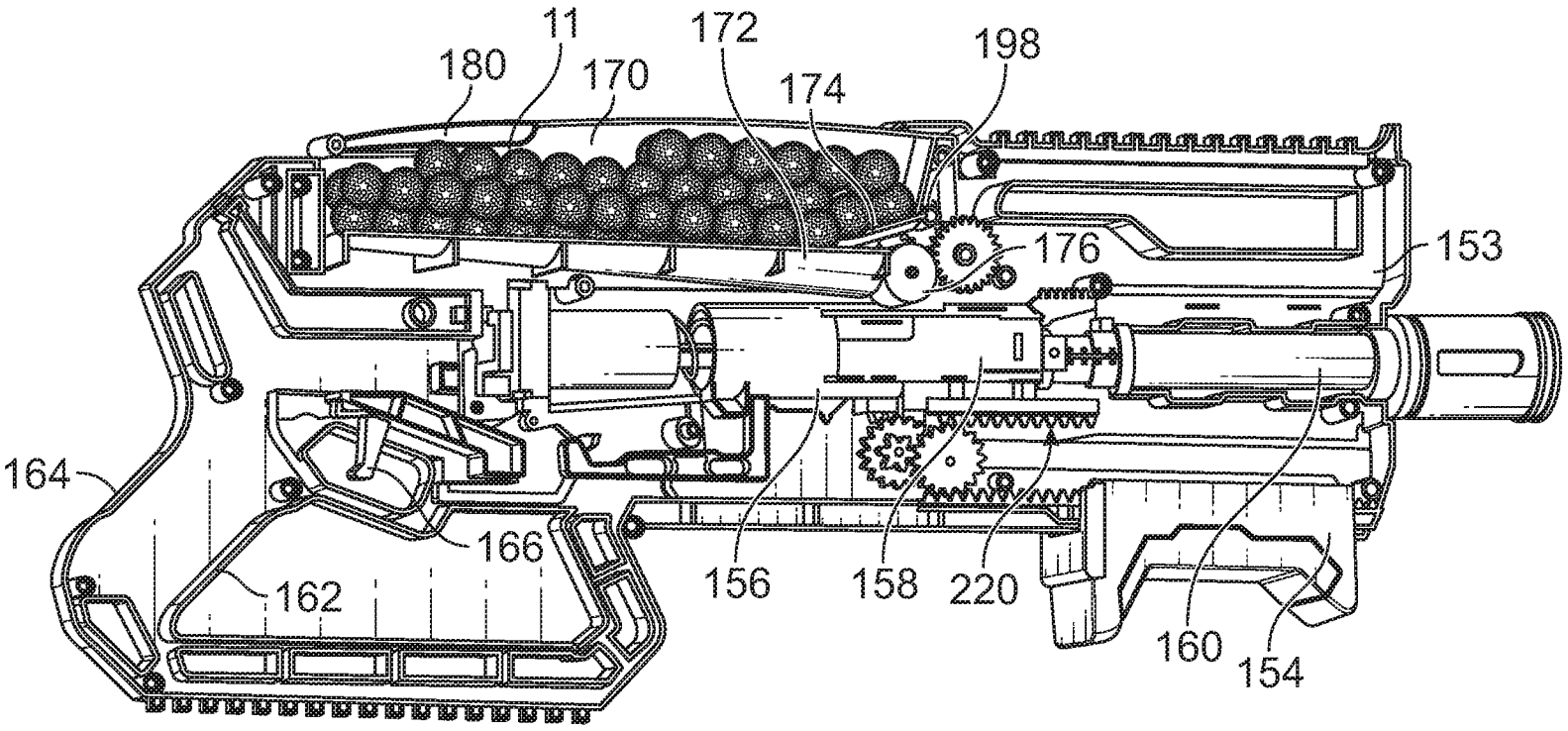
FIG. 15 is a side elevation view of the launcher illustrated in FIG. 14, with part of its outer housing removed to show its interior.

Another preferred embodiment of a toy launcher 150 for discharging soft spherical projectiles is illustrated in FIGS. 14 and 15. The launcher 150 includes an outer housing 152 including a base portion 153 and a priming handle portion 154, the handle 154 being located below the outer housing. Like with the launcher 10, the base portion 153 of the outer housing 152 supports an energy source 156, a breech 158, a barrel 160, a trigger guard 162, and a grip 164. A trigger mechanism 166 may be mounted in the outer housing 152 for activating the energy source 156.

Also mounted in the outer housing 152 are a loading system including a projectile hopper 170, FIG. 15, a chute 172, an agitator 174 and a projectile transfer structure 176.

The hopper 170 is able to hold a large quantity of soft projectiles, such as the projectile 11. As mentioned above, the projectiles may be small foam spheres having a diameter a little less than about 0.6 inches. The hopper may be loaded through an opening beneath a closure panel 180.

Figure 16:
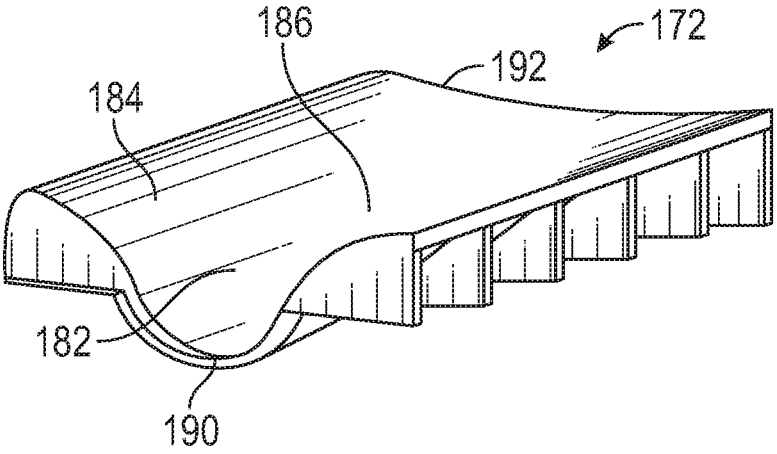
FIG. 16 is an enlarged isometric view of a loading system chute of the launcher illustrated in FIGS. 14 and 15.

Referring to FIG. 16, the chute 172 includes a central groove 182 bordered by two sloping surfaces 184, 186, a forward end 190 and a rearward end 192. The surfaces 184, 186 are slanted toward the groove 182 and the chute is mounted to slope downward toward the forward end 190 such that spherical projectiles tend to roll toward the groove 182 and toward the forward end 190 of the chute. The groove is narrow enough to allow a small percentage of projectiles to line up in a single file line at a level below other projectiles that are above the single file line.

Figure 17:
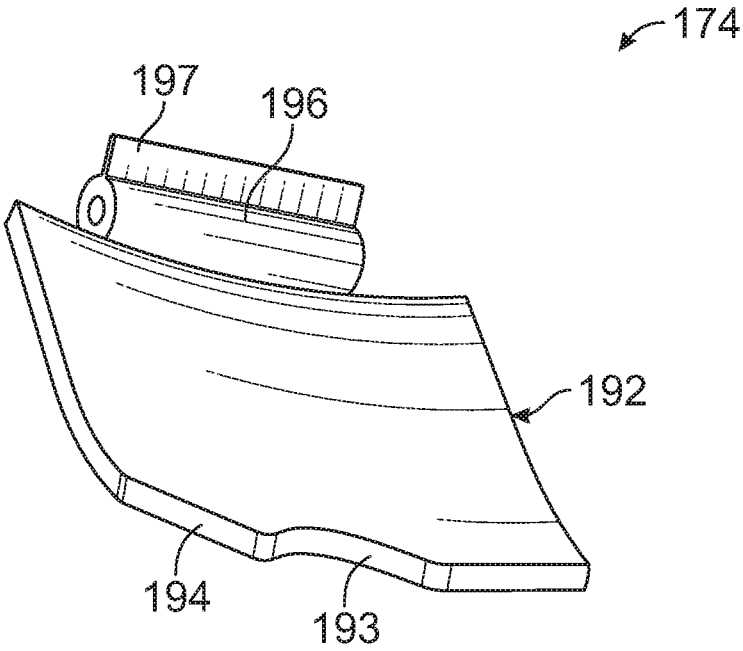
FIG. 17 is an enlarged downward-looking isometric view of a loading system agitator.
Figure 18:
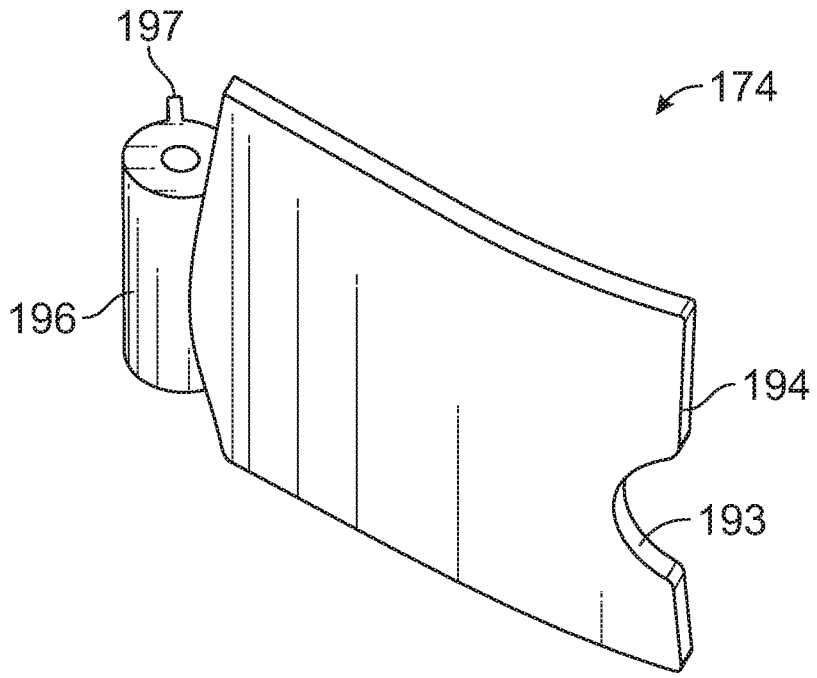
FIG. 18 is an upward looking isometric view of the agitator illustrated in FIG. 17.

Referring to FIGS. 15, 17 and 18, the agitator 174 is mounted to the outer housing 152 in a rotatable manner so as to disturb the projectiles when moved. The agitator 174 is formed as a lever or shovel 192 with a recess 193 in a forward end 194 of the agitator. When the agitator 174 rotates, the lever 192 disturbs or agitates close-in projectiles while allowing single projectiles to fall into the groove 182 of the chute 172. The agitator 174 includes a lateral support tube 196 to allow rotation of the agitator, as well as a cam flange 197. A shaft 198, FIG. 15, located through the lateral tube 196 supports the agitator.

Figure 19:
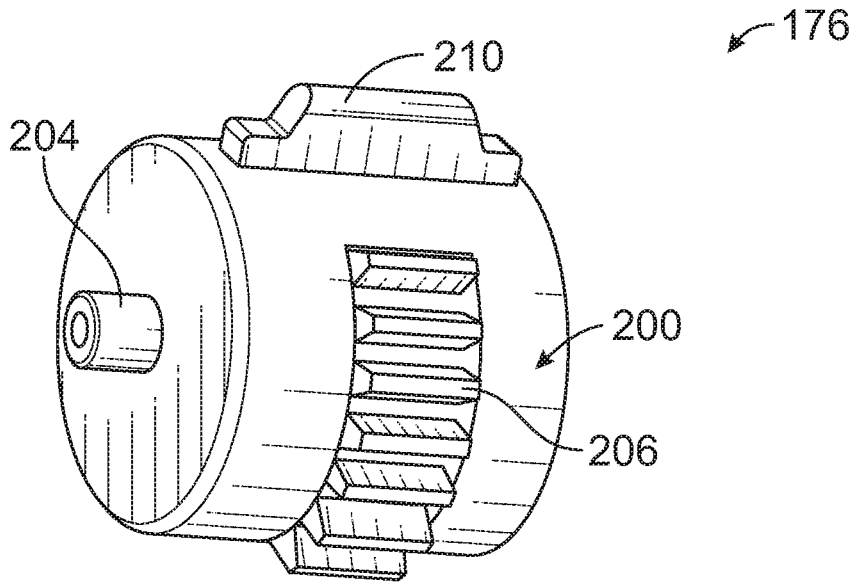
FIG. 19 is an enlarged isometric view of the front of a loading system projectile transfer structure.
Figure 20:
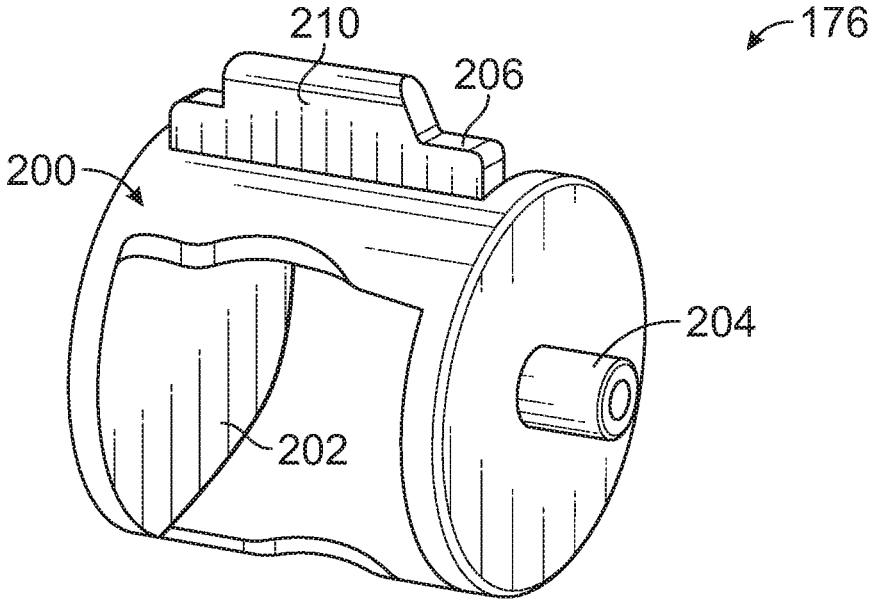
FIG. 20 is an isometric view of the rear of the projectile transfer structure illustrated in FIG. 19.

The transfer structure 176, FIGS. 15, 19 and 20, may have the form of a cylindrical housing 200 with an opening 202 to receive and discharge a projectile, opposite mounting shafts, of which only the shaft 204 is shown, to allow rotation, gear teeth, collectively labeled 206, and a can element 210. Rotation of the transfer structure 176 causes the cam element 210 to lift and lower the agitator 174. Unlike the launcher 10, rotation of the transfer structure of the launcher 150 is caused by a gear train 220, FIGS. 15, 21, 22 and 23.

Figure 21:
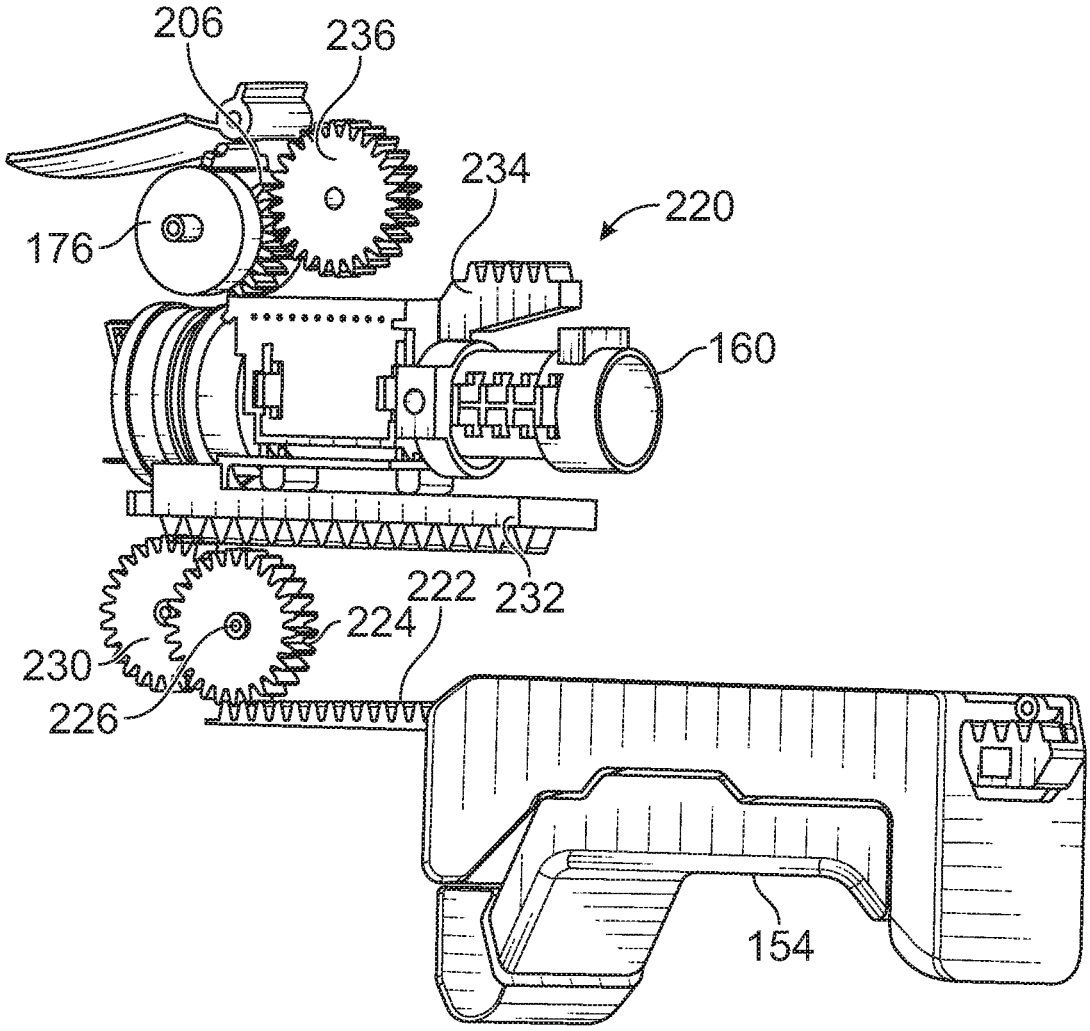
FIG. 21 is a right side isometric view of a loading system gear train and priming handle.
Figure 22:
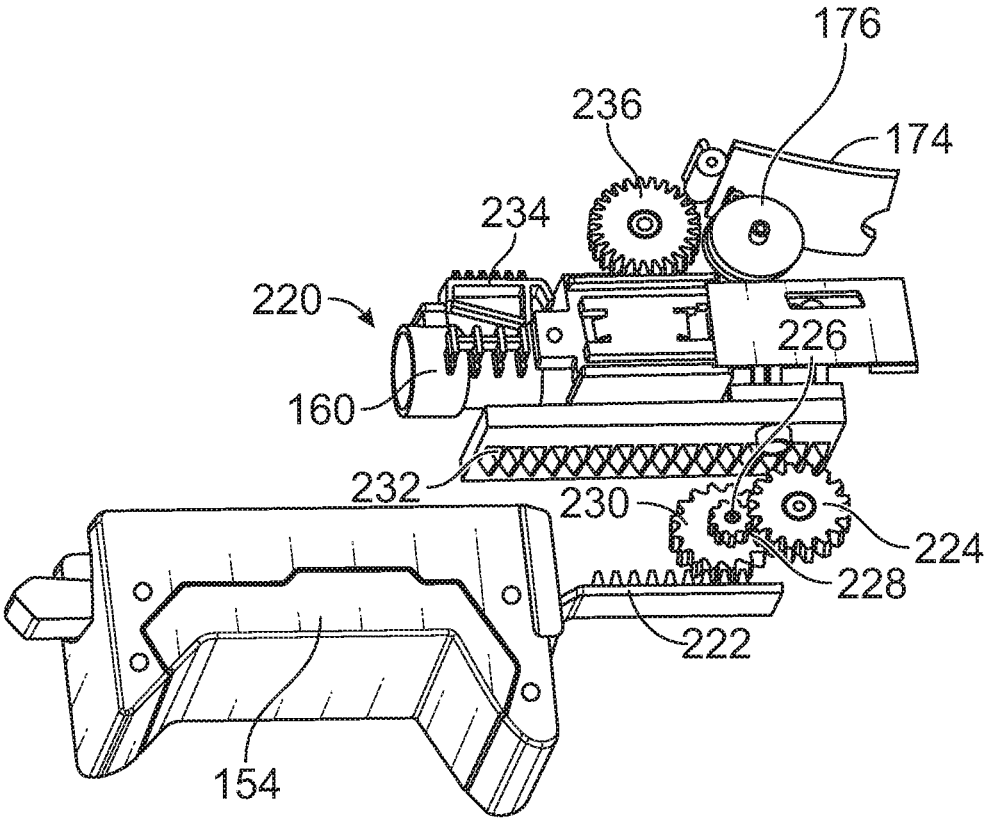
FIG. 22 is a left side isometric view of the gear train and priming handle illustrated in FIG. 21.
Figure 23:
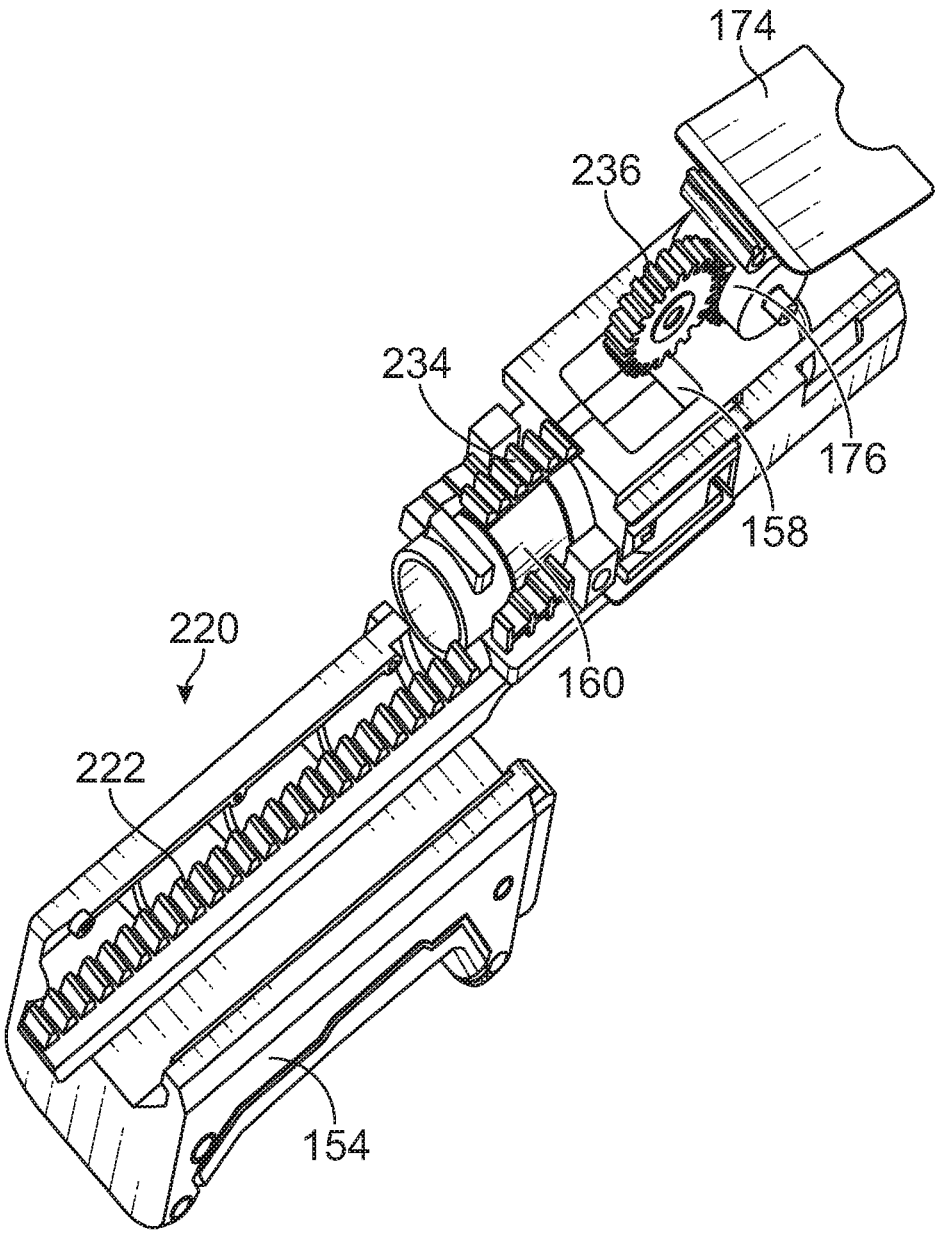
FIG. 23 is a downward looking isometric view of the gear train and priming handle illustrated in FIGS. 21 and 22.

The gear train 220, FIGS. 21-23, is activated when an operator moves the priming handle 154 rearward and then forward in the usual fashion of a shotgun. Attached to the handle 154 is a gear rack 222 that rotates a first round gear 224 when the handle 154 is pulled rearward and then forward by an operator during a priming cycle. The first round gear 224 is mounted on the same shaft 226 as a second small round gear 228 that rotates a third bigger gear 230. The third gear 230 engages a second rack 232 mounted to the underside of the breech 158, and a third short rack 234 is mounted above the barrel 160. The third rack 234 is able to engage a fourth round gear 236 that in turn engages the gear teeth 206 on the transfer structure 176 thereby causing rotation of the transfer structure to drop a projectile into the breech.

In operation, the handle portion 154 is pulled rearward and pushed forward to prime the launcher. When going through the priming cycle, the transfer structure discharges a projectile into the breech and loads another projectile from the hopper while at the same time the agitator is rotated to disturb the projectiles in the hopper to prevent the projectiles from sticking or binding to each other.

Referring now to FIGS. 24-29, there is shown another toy launcher embodiment 250 of soft spherical projectiles, the launcher 250 being battery operated. The launcher 250 includes a portion of an outer housing 252, of a battery 253 mounted in the outer housing, a motor 254, two spaced apart launch wheels or rollers 255, 256 (also sometimes referred to as 'flywheels') energized by the motor 254, a barrel 251, a gear train 257, and an agitator gate 258 in a hopper 259. Off to the side in the hopper 259 are a projectile feed belt or projectile feed track 260 and an agitator assembly 261, both mounted at an angle of about 30° from a vertical reference. The agitator assembly 261 includes a series of agitator disks, such as the agitator disk 262, mounted on a rotatable shaft 263. The projectile feed track 260 is similar to a track on a tractor or a tank and moves over gear-like agitating rollers, such as the agitating roller 264, to facilitate agitation of the spherical projectiles, which tend to aggregate or bind in the hopper and on the projectile feed track 260, as they move toward the launch wheels 255, 256.

The projectiles intended for use in the launcher 250 are the small soft foam spheres 11, FIG. 5, having large and small dimples 12, 13, respectively. The tunnel structure between the hopper and the pair of rotatable launch wheels directs the soft toy projectiles to the pair of rotatable launch wheels wherein the length of the tunnel structure may be within an approximate range of two to five times the size of the gap between the pair of rotatable launch wheels, with the inside diameter of the tunnel structure of an approximate range of three to five times the size of the gap between the pair of rotatable launch wheels. As mentioned, the soft spheres 11 have a tendency to bind and/or overlap, especially at the entrance of a feed tunnel located upstream of the launch wheels 255, 256. The binding problem is relieved by the placement of a small compression roller 265, FIG. 28, located near an end portion of the projectile feed track 260. The compression roller 265 is positioned parallel to the projectile feed track 260. The bottom of the compression roller 265 is about 13.8 mm from the top of the projectile feed track 260, such that each foam sphere is squeezed slightly between the compression roller 265 and the projectile feed track 260. The compression roller 265 is intended to resolve binding and/or overlapping of the soft spherical projectile 11 should binding occur. The compression roller 265 introduces a 'pressure-release' feature within the feed system, and because of the material and durometer of the soft spheres they compress easily and resist movement the more the soft spheres compress, especially against another soft sphere. The compression roller 265 does not revolve much under typical conditions because the 'squeeze' is only about 1 mm, however, the compression roller increases revolutions as more load is applied, such as when the soft spheres start to bind/overlap. Because the soft sphere material is designed to grip, the compression roller 265 facilitates the undoing of any binding by increasing revolutions to allow the soft sphere first in line to move forward and free itself from the next-in-line soft sphere. The compression roller 265 is not motorize, geared or spring-loaded, but is free rolling, and is about 5 min diameter.

Figure 29:
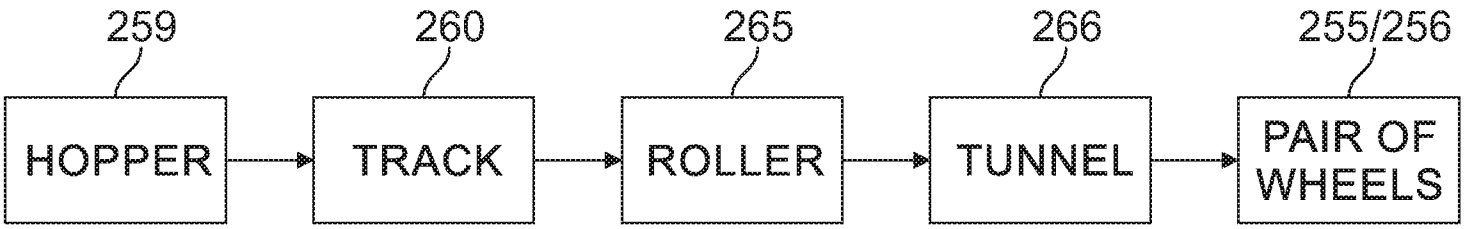
FIG. 29 is a flow diagram illustrating movement of a spherical projectile from the hopper to the pair of battery operated launch wheels.

Located between the compression roller 265 and the launch wheels 255/256 is a feed tunnel 266 that directs the soft spherical projectiles 11 to the launch wheels after the projectiles pass the compression roller. The feed tunnel 266 may have an inside diameter of about 17.8 mm or within a range of approximately 17 to 18.5 mm, and a length of about 12.7 mm or within a range of approximately 10 to 15 mm. A flow diagram, FIG. 29, illustrates the route taken by a foam projectile from the hopper 259, along the projectile feed track 260, passed the compression roller 265, through the feed tunnel 266 and to the pair of launch wheels 255/256.

Two triggers, a lower trigger 268 and an upper trigger 270 operate the launcher 250. The lower trigger 268 activates the motor 253 causing the launch wheels 255, 256 to spin. A soft projectile passing between the wheels 255, 256 is shot out from the launcher. The upper trigger 270 is connected to the agitator gate 258 by a rod 274 and a cam 276. Pulling the upper trigger 270 causes the cam 276 to raise the gate 258 and when the upper trigger is released, a spring 278 causes the agitator gate 258 to return to its original position shown in FIG. 26. The upper trigger 270 also activates the side agitator assembly 261 in the hopper 259 and the projectile feed track 260 that feeds the projectiles through the gate 258 and onto the launch wheels 255, 256.

Figure 24:
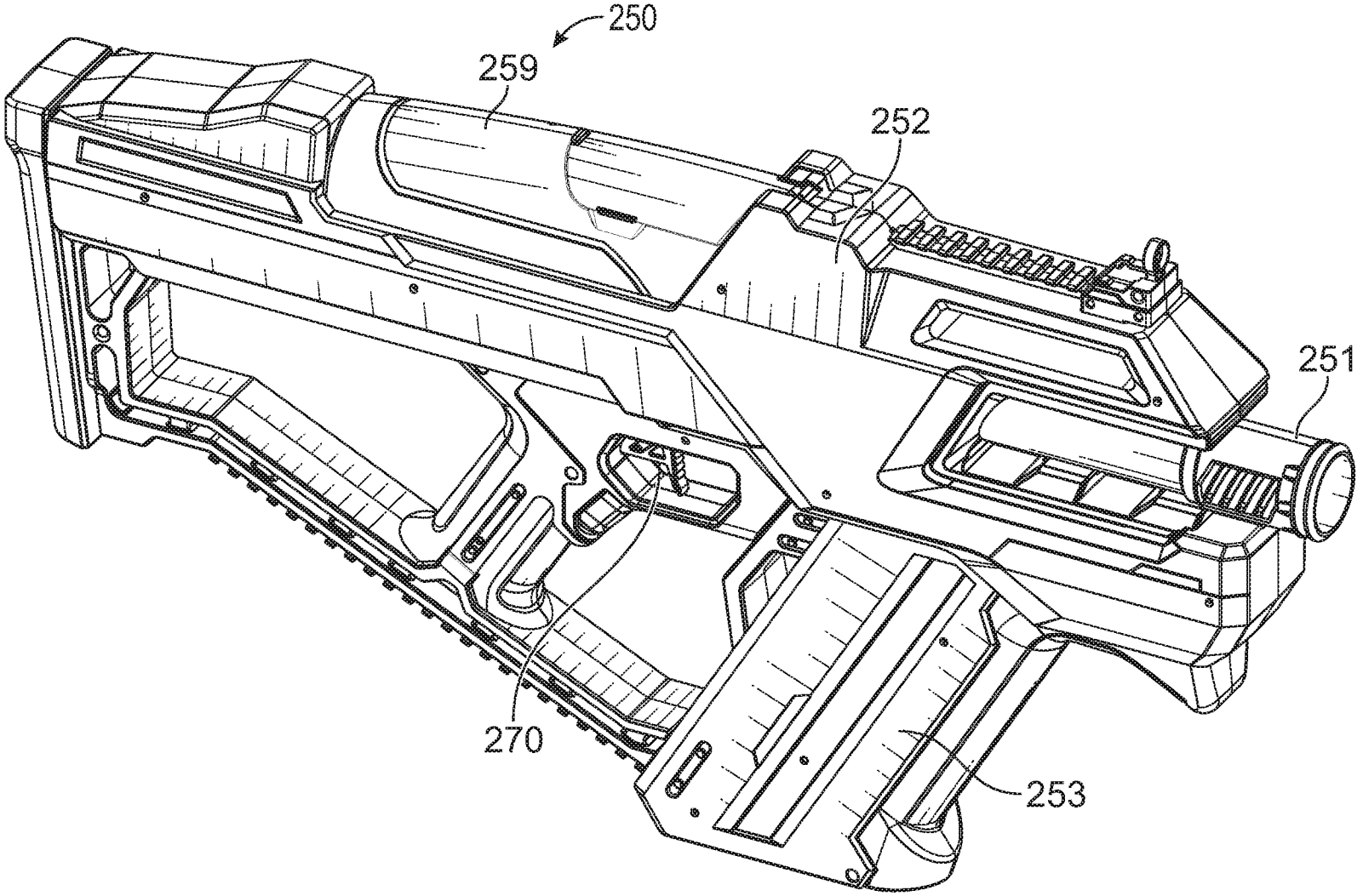
FIG. 24 is an isometric view of yet another embodiment of a toy launcher having a projectile loading system and battery operated launch wheels.
Figure 24A:
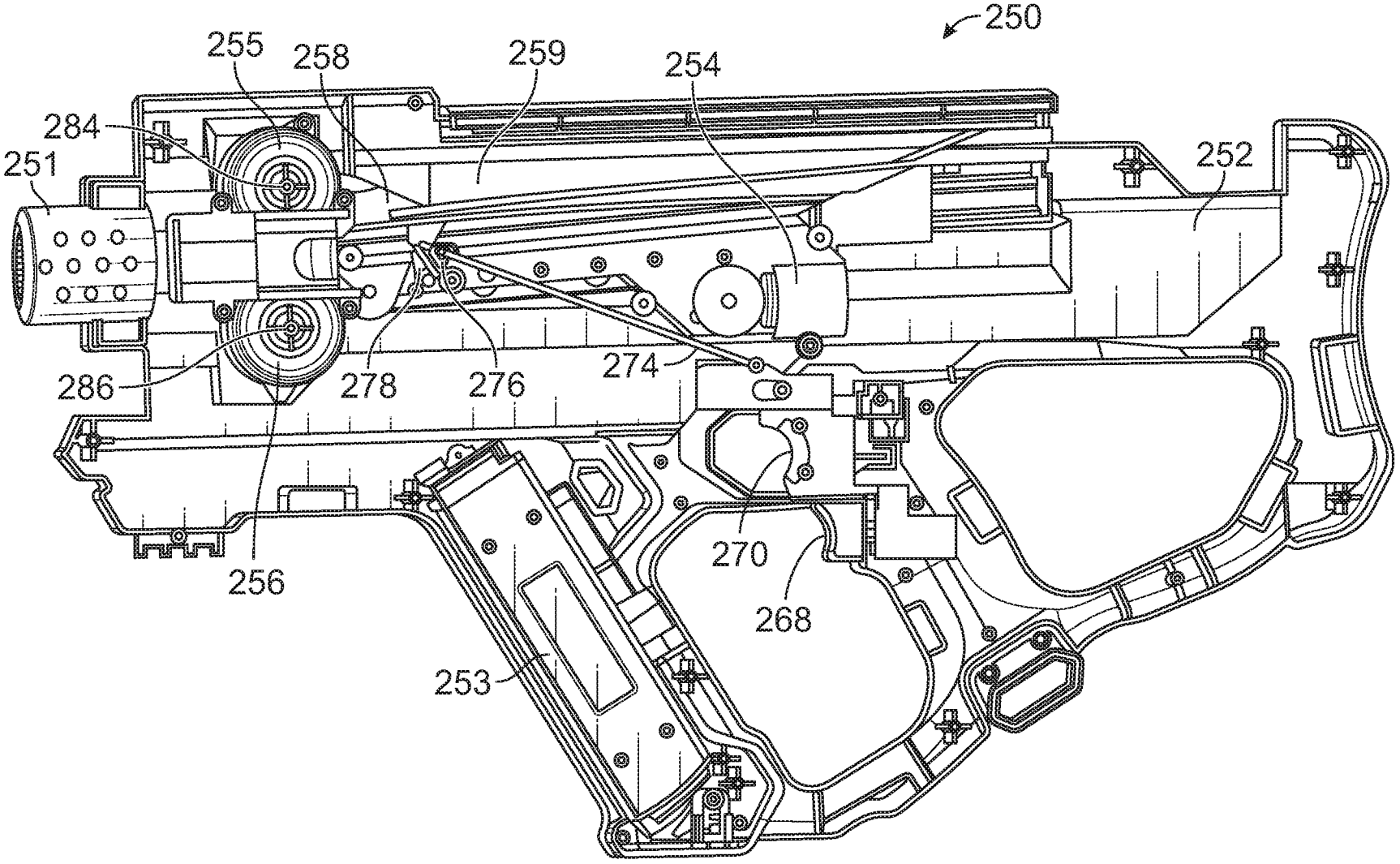
FIG. 24A is a side view of the toy launcher shown in FIG. 24 with a portion of the outer housing removed.
Figure 25:
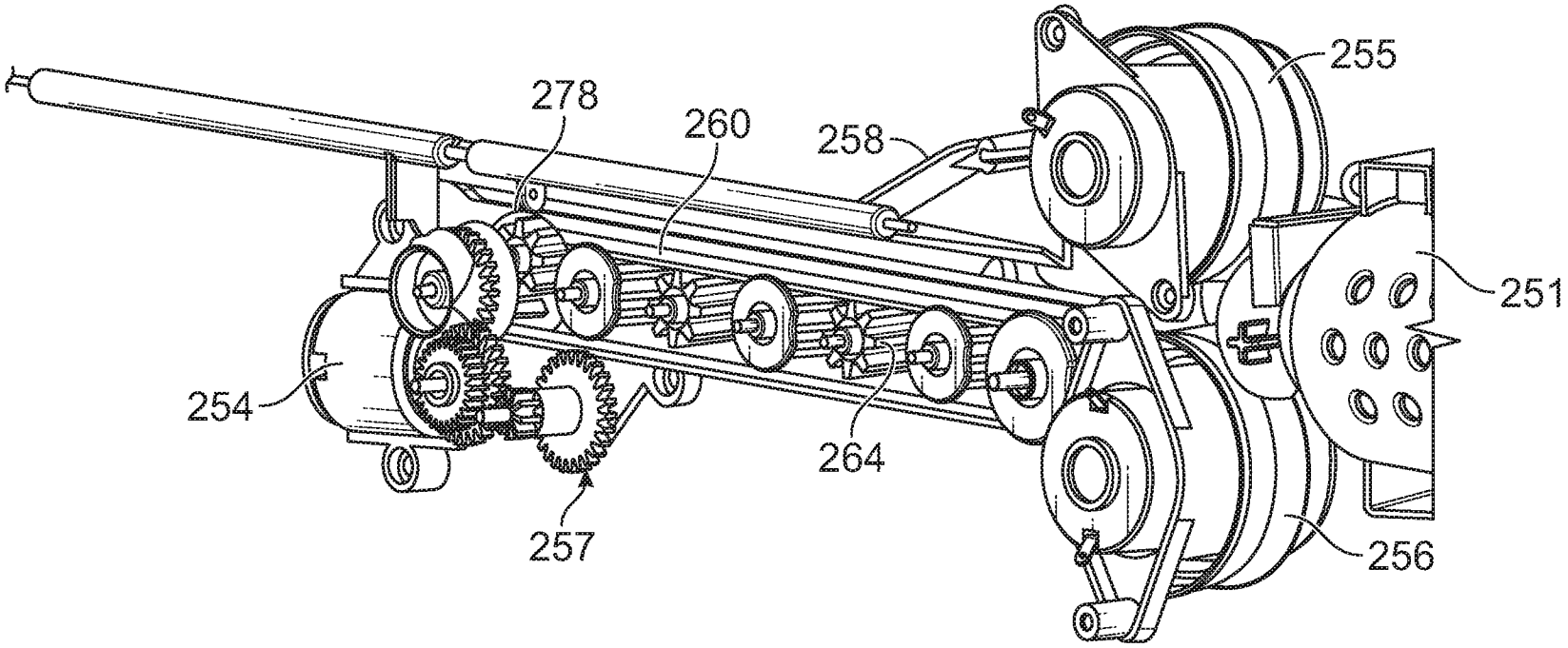
FIG. 25 is an isometric view of a gear train, and a belt or feed track of the toy launcher shown in FIG. 24.
Figure 26:
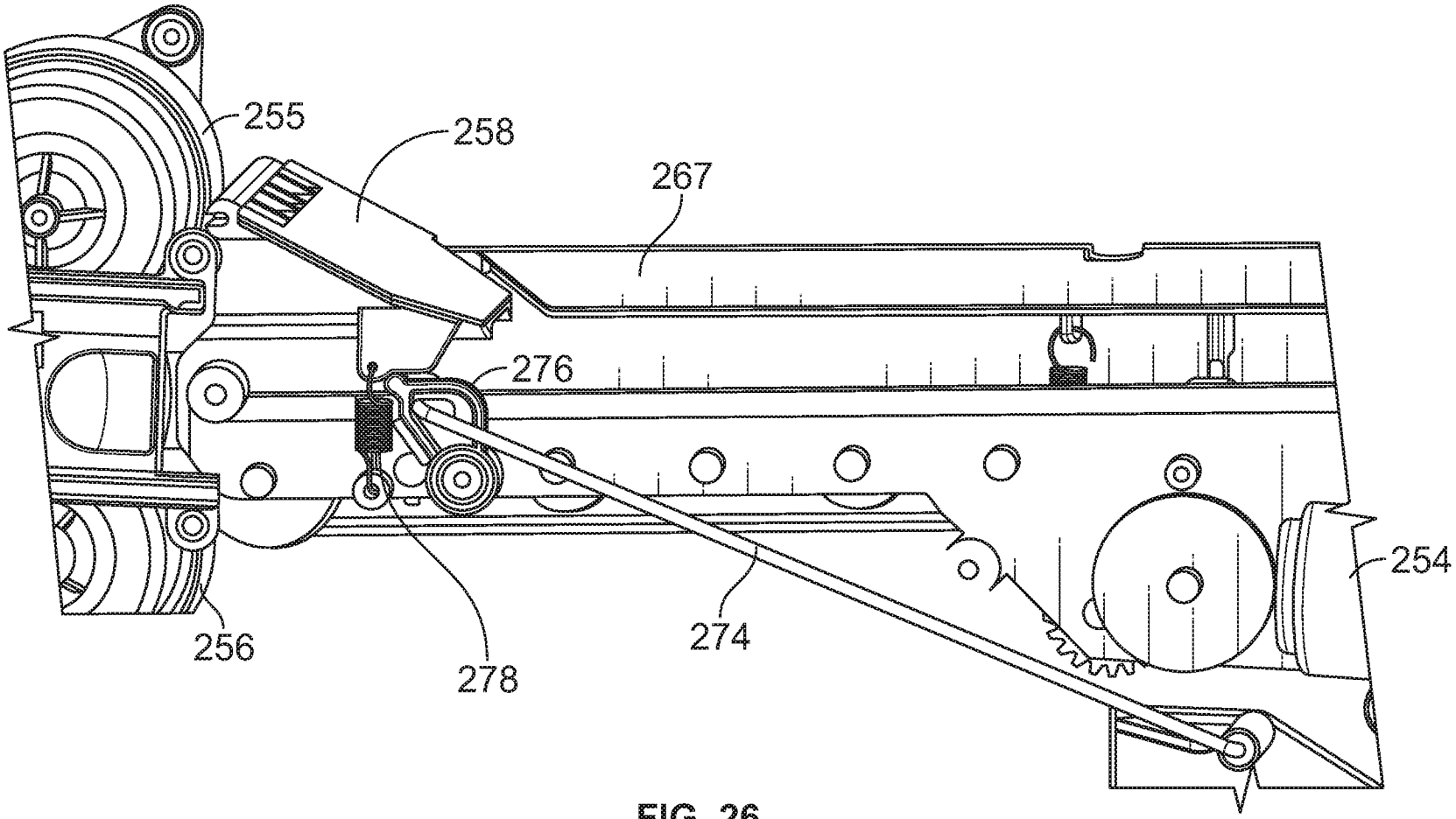
FIG. 26 is an isometric view of an agitator gate in the toy launcher shown in FIG. 24.
Figure 27:
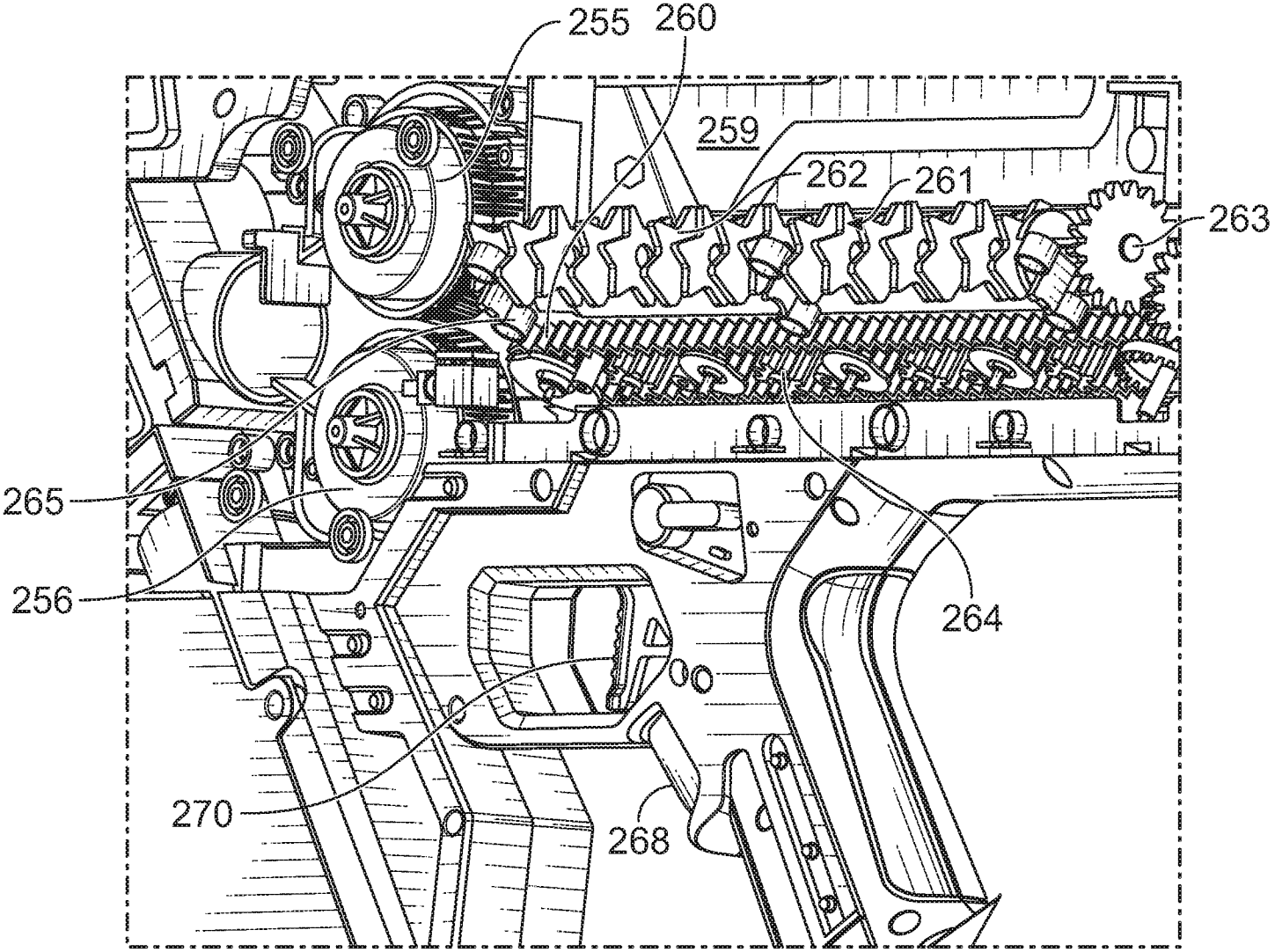
FIG. 27 is an isometric view of an agitator assembly with the feed track in a projectile hopper.
Figure 28:
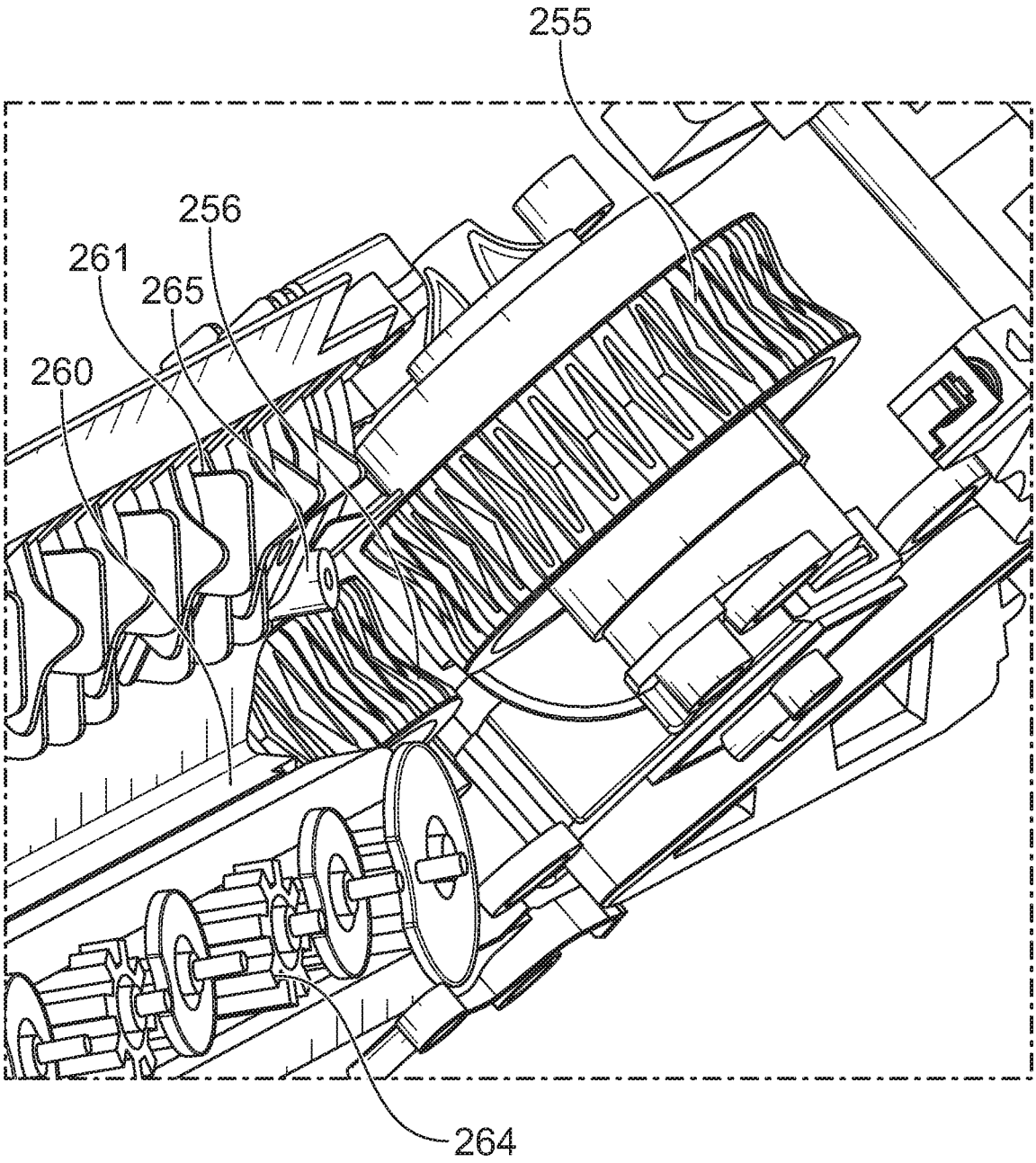
FIG. 28 is a front isometric view of the feed track, the launch wheels and a compression roller.
Figure 31:
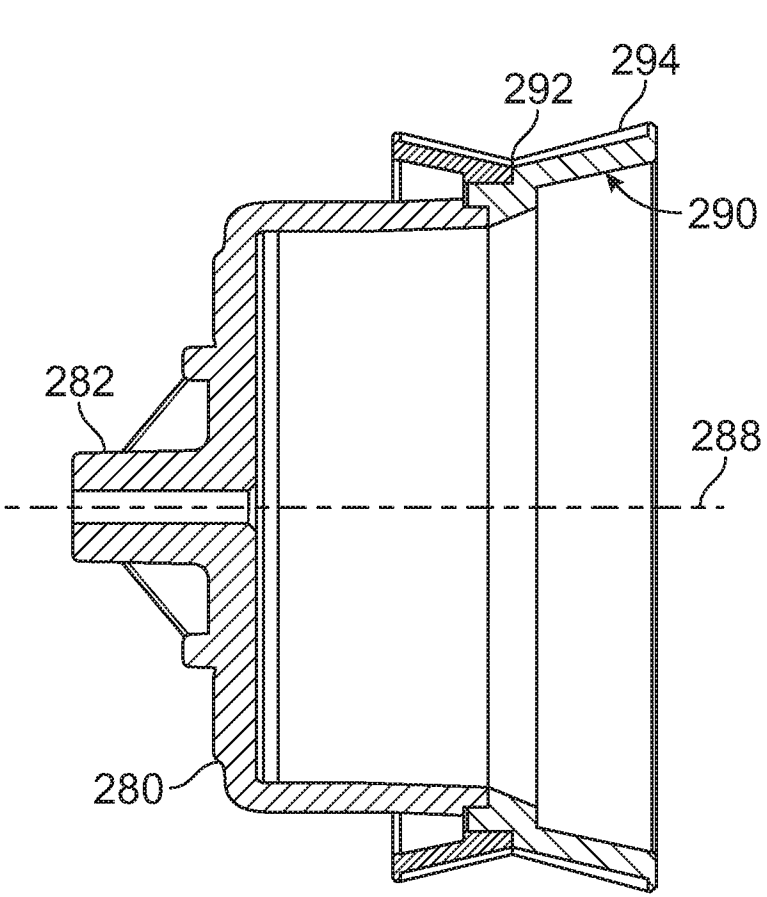
FIG. 31 is a cross-section view of the launch wheel shown in FIG. 30.
Figure 30:
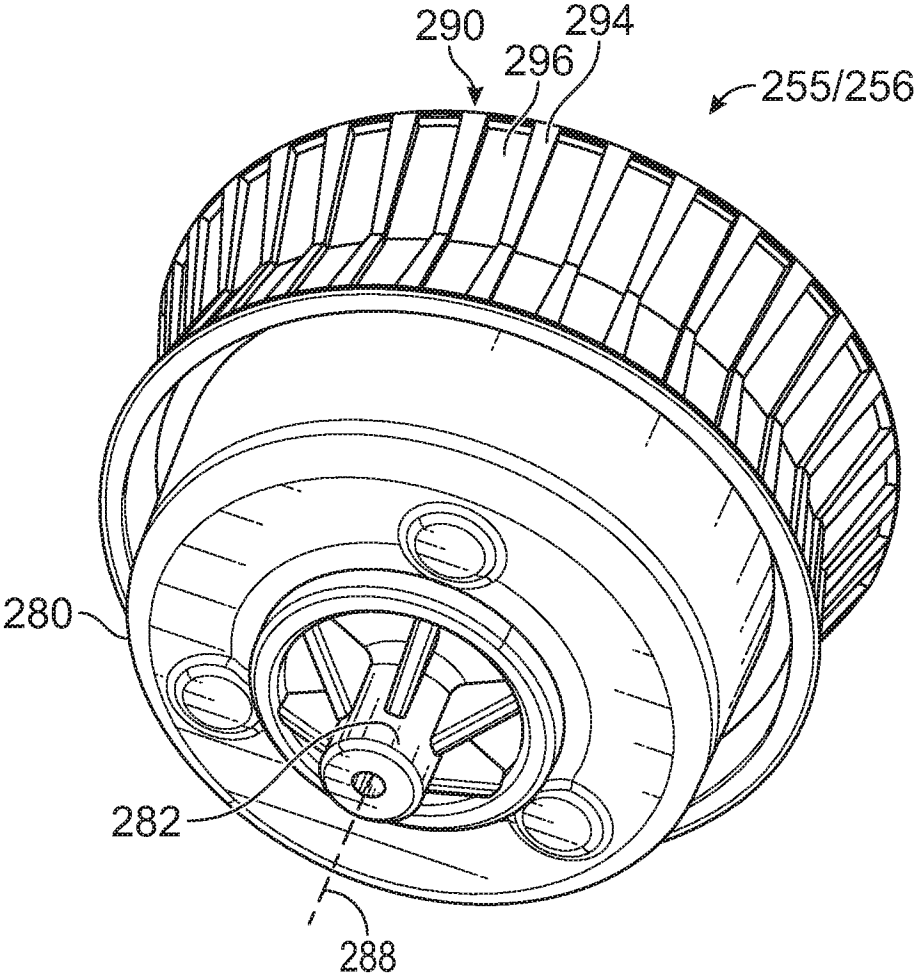
FIG. 30 is an isometric view of a launch wheel embodiment for use in the launcher shown in FIG. 24.
Figure 33:
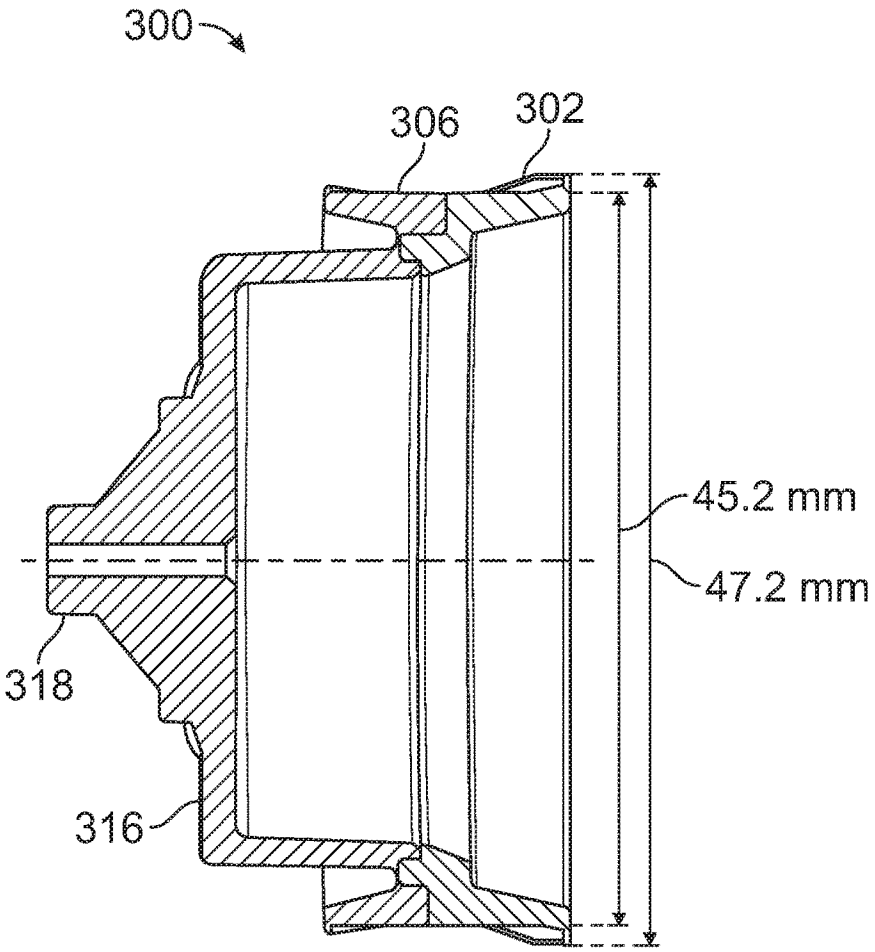
FIG. 33 is a cross-section view of the launch wheel shown in FIG. 32.

Each of the launch wheels 255, 256 may take the form of the roller 255/256 illustrated in FIG. 30, and includes a base portion 280 having a bushing 282 for receiving a shaft 284, 286, FIG. 24, that causes the roller to rotate around an axis of rotation 288. Attached to the base portion 280 of the wheel is a projectile contact portion 290. FIG. 24A is a side view of the toy launcher shown in FIG. 24 with a portion of the outer housing removed. The contact portion 290 may have a V-shaped cross section 292, FIG. 31, of alternating longitudinally extending protrusions or ramps 294 and valleys 296, FIG. 30. Spherical projectiles, such as the small spheres 11, FIGS. 2 and 5, (also known as 'Rounds') are delivered to the two launch wheels 255, 256 one at a time, with the wheels rotating is opposite directions, to cause the projectiles to be gripped and compressed by the ramps 294 of the launch wheels 255, 256 and ejected at a substantial velocity.

Figure 32:
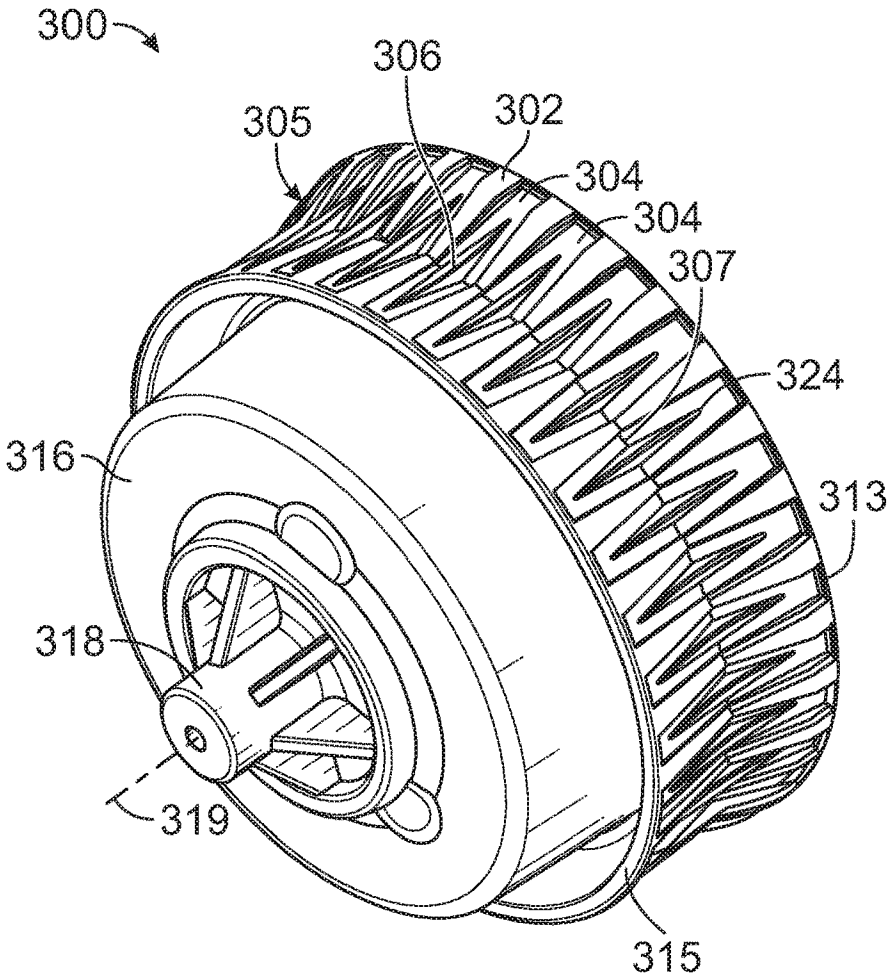
FIG. 32 is an isometric view of an improved launch wheel embodiment for use in the launcher shown in FIG. 24.

An improved launch wheel embodiment 300 is illustrated in FIGS. 32-35, and may also have ramps 302 and valleys 304, FIG. 32, in a projectile contact portion 305. The launch wheel 300, however, also includes a rib 306 extending across or bridging each valley 304. The rib 306, FIGS. 32 and 33, increases the outer diameter of each launch wheel at the V-shaped cross section 307 to better grip the spherical projectile 11 delivered to a pair of ribs, such as the ribs 308, 310, FIG. 34, of spinning launch wheels 312, 314. The launch wheels 312, 314 are arranged like the wheels 255, 256. As illustrated in diagrammatic fashion in FIG. 35, the aligned pair of ribs 308, 310 of the spinning launch wheels 312, 314, respectively, grip and compress each spherical projectile 11 as the projectile passes between the two launch wheels. Each of the launch wheels 312, 314 includes an outer rim 313, FIG. 32, and an inner rim 315, a base portion 316, a bushing 318, and an axis of rotation 319.

Figure 34:
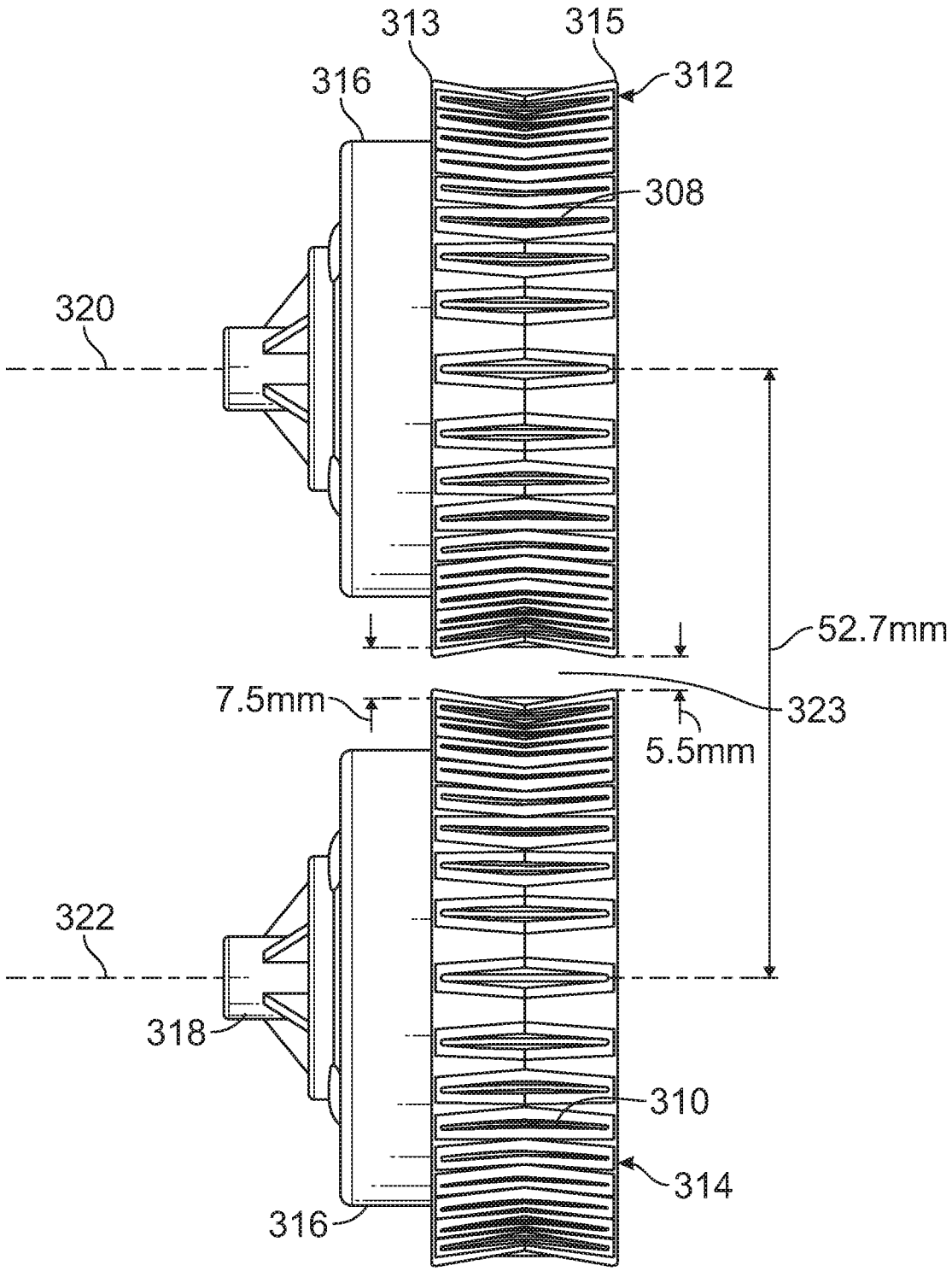
FIG. 34 is an elevation view of two improved launch wheels that may be used in the launcher shown in FIG. 24, illustrating the relative positions of the wheels.
Figure 35:
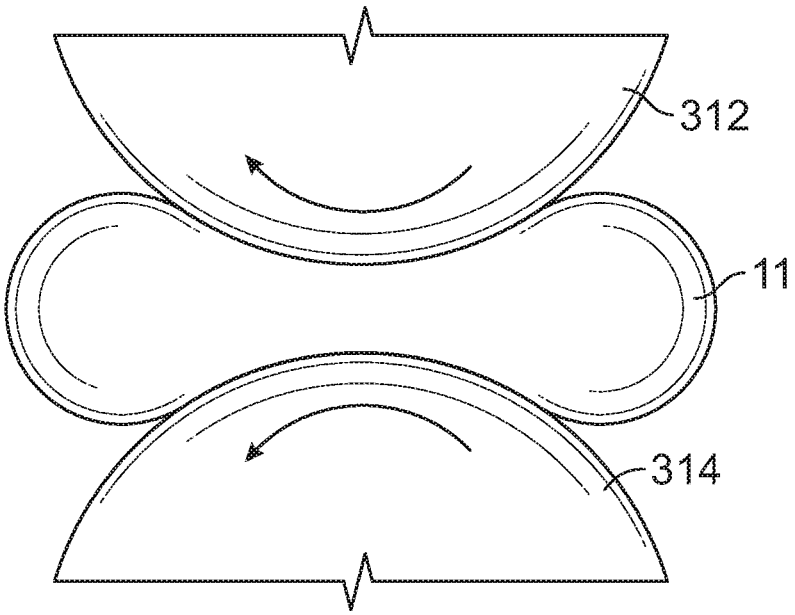
FIG. 35 is a diagrammatic view of a spherical projectile passing between the two launch wheels shown in FIG. 34, and illustrating the process of transferring energy from the launch wheels to the projectile.

Referring again to FIG. 34, the launch wheels 312, 314 are shown with one wheel 312 above the other wheel 314, such that the axes of rotation 320, 322 of the wheels 312, 314 are parallel. It is to be noted that a user typically holds the launcher 250 in the position illustrated in FIGS. 24 through 27. Hence, the axes of rotation 320, 322 of the two wheels 312, 314 are disposed in a generally horizontal direction. As mentioned above, the spherical projectiles 11 may have a diameter of about 14.8 mm, the distance between the rotational axes 320, 322 of the wheels 312, 314 may be about 52.7 mm, the diameter of the outer rim 313 may be about 47.2 mm, the diameter of the inner rim may be about 45.2 mm, the width of each wheel may be about 16 mm, and the space or gap 323 between the wheels 312, 314 may be about 5.5 mm at the inner rim 313 and 7.5 mm at the outer rim, as shown in FIG. 34. To facilitate compression of the projectile 11, the top or outer surface 324, FIG. 32, of each rib 306 may be about 1.1 mm in width. A preferred velocity of the wheels 312, 314 in use may be within an approximate range of 19,000 to 22,500 rpm. With the above-mentioned dimensions and characteristics, the spherical projectiles 11 may be launched from the barrel 251, FIGS. 24 and 25, at up to about 110 feet per second, a very desirable velocity.

The dimensions, 14.8 mm for the diameter of each projectile and 5.5 to 7.5 mm for the gap 323 of the spaced apart launch wheels, offers the result in that the launch velocity of each projectile is up to about 110 feet per second. Stated in another way, the ratio of the dimension of each projectile at-rest, namely the diameter of 14.8 mm, and the size of the gap, 5.5 to 7.5 mm, to which each projectile is momentarily compressed when the projectile passes between the launch wheels, is about 2.3 to 1. Each projectile is compressed to about 44% of its at-rest dimension. Finally, the rpm of the motor 254 with no load is about 23,000+/−8% or a range of 21,160-24,840 rpm, and with a load, the rpm of the motor is about 19,500+/−8% or a range of 17,940-21,060 rpm.

It should be noted that in the alterative, the launch wheels may be placed side by side so that their axes of rotation are still parallel but they may extend in a generally vertical direction. Also in the alternative, other projectiles may be used having different characteristics, and, in view of the altered characteristics of the projectiles, the loading system may have different dimensions and, perhaps, different component arrangements.

It is noted that throughout this detailed description, words such as "upper," "lower," "front," "back," "rear," "rearward," "forward," "top" and "bottom," as well as similar positional terms, refer to portions or elements of the launchers as they are viewed in the drawings, or in relationship to the positions of the launchers as they will typically be deployed and moved during use, or to movements of elements based on the configurations illustrated.

Figure 36:
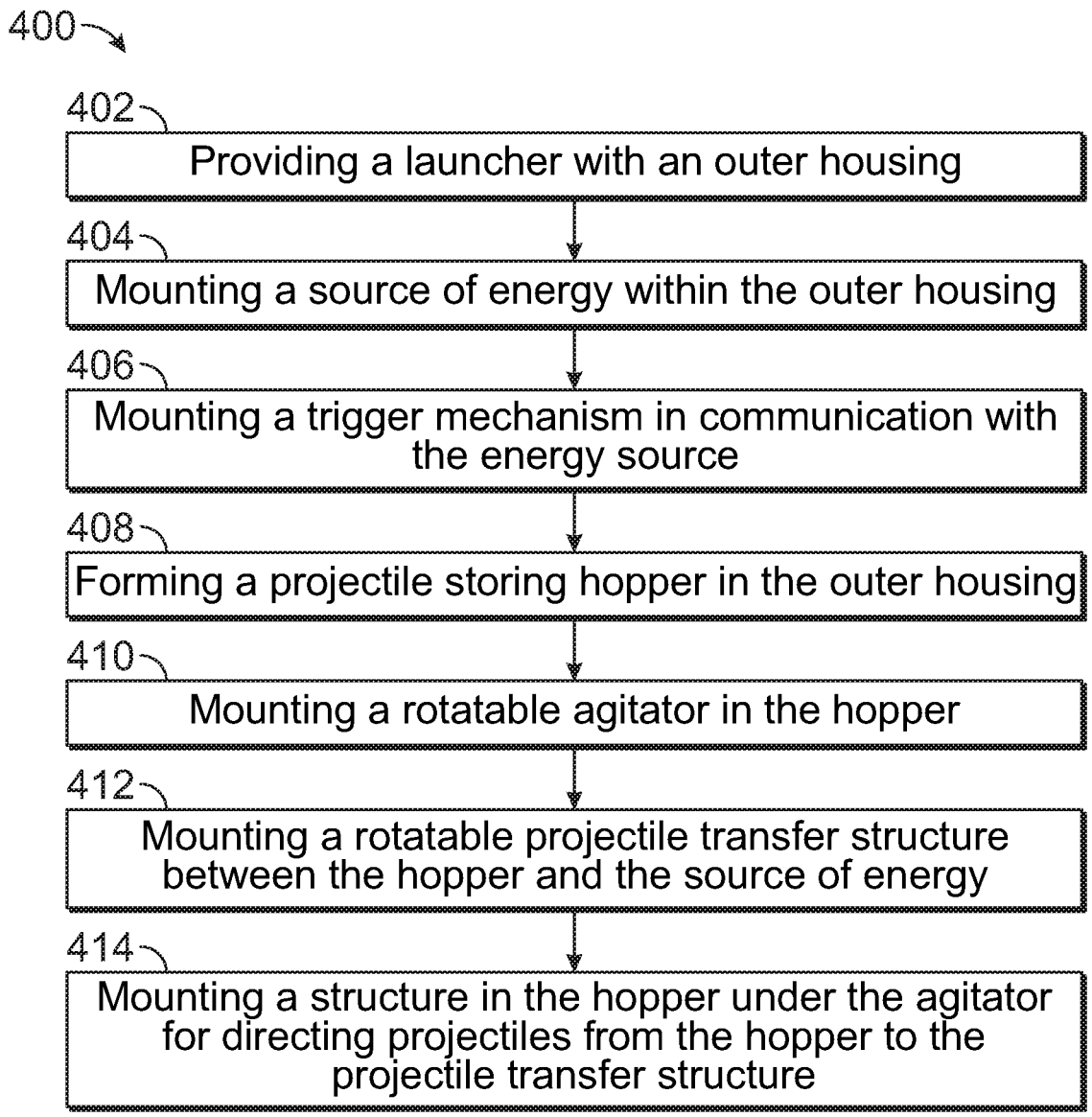
FIG. 36 is a flow diagram of a method for assembling a launcher.

The present invention includes a method 400, FIG. 36, for assembling a projectile loading system for a toy launcher including the steps of providing a launcher with an outer housing 402, mounting a source of energy within the outer housing 404, mounting a trigger mechanism in communication with the energy source 406, forming a projectile storing hopper in the outer housing 408, mounting a rotatable agitator in the hopper 410, mounting a rotatable projectile transfer structure between the hopper and the source of energy 412, and mounting a structure in the hopper under the agitator for directing projectiles from the hopper to the projectile transfer structure 414.

It may now be appreciated that the toy projectile launchers disclosed in detail above has great entertainment value, is fun to use and easy to operate. The launchers are compact, lightweight and yet robust, and have a simple structure that may be produced at a reasonable cost.

From the foregoing, it can be seen that there has been provided a detailed description and features for improved toy launchers for handling a particular soft projectile, as well as a disclosure of a method for assembling the launchers. While particular embodiments of the present invention have been shown and described in detail, it will be obvious to those skilled in the art that changes and modifications may be made without departing from the invention in its broader aspects. Therefore, the aim here is to cover all such changes and modifications as fall within the true spirit and scope of the invention. The matters set forth in the foregoing description and accompanying drawings are offered by way of illustrations only, and not as limitations. The actual scope of the invention is to be defined by the subsequent claims when viewed in their proper perspective based on the prior art.

What is claimed is:

1. A projectile loading system for a toy launcher comprising:

an outer housing;

a hopper located in the outer housing for storing multiple soft spherical projectiles;

a launch energy source located within the outer housing;

a projectile transfer structure to enable the multiple soft spherical projectiles to move one at a time into communication with the energy source;

a rotatable agitator located in the hopper for disturbing the multiple soft spherical projectiles;

directing structure at the hopper for soft spherical projectiles movement toward the projectile transfer structure, the directing structure being under the agitator, the agitator disturbing the soft spherical projectiles with their movement toward communication with the source of energy, wherein the directing structure is an elongated chute having a forward portion slanted downward toward a rearward portion, the rearward portion includes a generally centrally located groove and a slanted wing on each side of the groove, the wings for biasing the soft spherical projectiles toward the groove; and a trigger mechanism connected to the energy source for activating the energy source to enable a launch of the multiple soft spherical projectiles one at a time.

2. The projectile loading system of claim 1, wherein:

between the forward and rearward portions of the chute is a smoothly curved transition portion for facilitating movement of the soft spherical projectiles.

3. A projectile loading system for a toy launcher comprising:

an outer housing;

a hopper located in the outer housing for storing multiple soft spherical projectiles;

a launch energy source located within the outer housing;

a projectile transfer structure to enable the multiple soft spherical projectiles to move one at a time into communication with the energy source;

a rotatable agitator located in the hopper for disturbing the multiple soft spherical projectiles, wherein the agitator includes a curved panel with asymmetrical side arms;

directing structure at the hopper for soft spherical projectiles movement toward the projectile transfer structure, the directing structure being under the agitator, the agitator disturbing the soft spherical projectiles with their movement toward communication with the source of energy; and a trigger mechanism connected to the energy source for activating the energy source to enable a launch of the multiple soft spherical projectiles one at a time.

4. The projectile loading system of claim 3, wherein:

the side arms are separated by a rounded protuberance.

5. A projectile loading system for a toy launcher comprising:

an outer housing;

a hopper located in the outer housing for storing multiple soft spherical projectiles;

a launch energy source located within the outer housing;

a projectile transfer structure to enable the multiple soft spherical projectiles to move one at a time into communication with the energy source;

a rotatable agitator located in the hopper for disturbing the multiple soft spherical projectiles, wherein the projectile transfer structure is a rotatable cylindrical housing having an opening to an interior space for one of the soft spherical projectiles, and the cylindrical housing having an outer surface;

a cam mounted on the outer surface of the cylindrical housing for operating the agitator;

directing structure at the hopper for soft spherical projectiles movement toward the projectile transfer structure, the directing structure being under the agitator, the agitator disturbing the soft spherical projectiles with their movement toward communication with the source of energy; and a trigger mechanism connected to the energy source for activating the energy source to enable a launch of the multiple soft spherical projectiles one at a time.

6. The projectile loading system of claim 5, wherein:

the projectile transfer structure includes gear teeth formed on the outer surface.

7. A projectile loading system for a toy launcher comprising:

an outer housing;

a hopper located in the outer housing for storing multiple soft spherical projectiles;

a launch energy source located within the outer housing;

a projectile transfer structure to enable the multiple soft spherical projectiles to move one at a time into communication with the energy source;

a guide rail located within the outer housing having a linear portion and a dip section, the guide rail for causing the projectile transfer structure to rotate;

a rotatable agitator located in the hopper for disturbing the multiple soft spherical projectiles;

directing structure at the hopper for soft spherical projectiles movement toward the projectile transfer structure, the directing structure being under the agitator, the agitator disturbing the soft spherical projectiles with their movement toward communication with the source of energy; and a trigger mechanism connected to the energy source for activating the energy source to enable a launch of the multiple soft spherical projectiles one at a time.

8. The projectile loading system of claim 7, wherein:

the hopper includes a top wall having a plurality of ribs.

9. A projectile loading system for a toy launcher comprising:

an outer housing;

a hopper located in the outer housing for storing multiple soft spherical projectiles;

a launch energy source located within the outer housing;

a projectile transfer structure to enable the multiple soft spherical projectiles to move one at a time into communication with the energy source;

a rotatable agitator located in the hopper for disturbing the multiple soft spherical projectiles;

directing structure at the hopper for soft spherical projectiles movement toward the projectile transfer structure, the directing structure being under the agitator, the agitator disturbing the soft spherical projectiles with their movement toward communication to a feed channel widened to align the soft spherical projectiles, wherein the energy source includes a battery, a motor and two rotatable launch wheels for gripping and ejecting the soft spherical projectiles; and a trigger mechanism connected to the energy source for activating the energy source to enable a launch of the multiple soft spherical projectiles one at a time.

10. The projectile loading system of claim 9, wherein:

the directing structure includes a feed track for soft spherical projectiles movement toward the projectile transfer structure.

11. The projectile loading system of claim 10, including:

a plurality of agitating rollers located beneath the feed track.

12. The projectile loading system of claim 9, wherein:

the rotating agitator includes a plurality of agitating disks mounted on a rotatable shaft.

13. The projectile loading system of claim 9, including:

a compression roller located at the end of the feed track for controlling projectile binding and overlap.

14. The projectile loading system of claim 9, wherein:

the directing structure includes a feed track for soft spherical projectiles movement toward the projectile transfer structure;

the rotating agitator includes a plurality of agitating disks mounted on a rotatable shaft; and including:

a plurality of agitating rollers located beneath the feed track; and a compression roller located at the end of the feed track for controlling projectile binding and overlap.

15. The projectile loading system of claim 9, wherein:

the directing structure is an elongated chute having a forward portion slanted downward toward a rearward portion, the rearward portion includes a generally centrally located groove and a slanted wing on each side of the groove, the wings for biasing the soft spherical projectiles toward the groove.

16. The projectile loading system of claim 15, wherein:

between the forward and rearward portions of the chute is a smoothly curved transition portion for facilitating movement of the soft spherical projectiles.

17. The projectile loading system of claim 9, wherein:

the agitator includes a curved panel including side arms separated by a rounded protuberance.

18. The projectile loading system of claim 9, wherein:

the projectile transfer structure is a rotatable cylindrical housing having an opening to an interior space for one of the soft spherical projectiles, and the cylindrical housing having an outer surface; and a cam mounted on the outer surface of the cylindrical housing for operating the agitator.

19. A method for assembling a projectile loading system for a toy launcher comprising the steps of:

providing a launcher with an outer housing;

mounting a source of energy within the outer housing;

mounting a trigger mechanism in communication with the energy source;

forming a projectile storing hopper in the outer housing;

mounting an agitator in the hopper;

mounting a rotatable projectile transfer structure between the hopper and the source of energy;

mounting a structure in the hopper under the agitator for directing projectiles from the hopper to the projectile transfer structure;

forming the directing structure as an elongated chute having a forward portion slanted downward toward a rearward portion;

forming a groove in the rearward portion of the chute;

forming a slanted wing on each side of the groove;

forming a smoothly curved transition portion between the rearward and forward portions of the directing structure for facilitating movement of the projectiles between the forward and rearward portions of the chute;

forming the agitator with a curved panel and asymmetrical side arms;

forming the projectile transfer structure with a cylindrical housing;

forming an opening to an interior space of the cylindrical housing, the housing having an outer surface; and mounting a cam on the outer surface of the cylindrical housing.

20. The method of claim 19, including the steps of:

forming a rounded protuberance between the side arms of the agitator; and mounting gear teeth on the outer surface of the projectile transfer structure.

* * * * *